US006801118B1

(12) United States Patent
Ikemoto et al.

(10) Patent No.: US 6,801,118 B1
(45) Date of Patent: Oct. 5, 2004

(54) LOW-RESISTANCE RESISTOR AND ITS MANUFACTURING METHOD

(75) Inventors: Koichi Ikemoto, Hyogo (JP); Yasuhiro Shindo, Osaka (JP); Norimitsu Chinomi, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/509,928

(22) PCT Filed: Oct. 1, 1998

(86) PCT No.: PCT/JP98/04427

§ 371 (c)(1),
(2), (4) Date: Jul. 20, 2000

(87) PCT Pub. No.: WO99/18584

PCT Pub. Date: Apr. 15, 1999

(30) Foreign Application Priority Data

Oct. 2, 1997 (JP) ..... 9-269561
Dec. 17, 1997 (JP) ..... 9-347471

(51) Int. Cl.[7] ..... H01C 1/012
(52) U.S. Cl. ..... 338/307; 338/313; 338/332
(58) Field of Search ..... 338/307, 308, 338/309, 313, 254, 206, 332

(56) References Cited

U.S. PATENT DOCUMENTS 4,509,034 A * 4/1985 Sakai ..... 338/34
4,588,976 A * 5/1986 Jaselli ..... 338/284
5,287,083 A * 2/1994 Person et al. ..... 338/332
5,294,910 A * 3/1994 Tani et al. ..... 338/306
5,379,016 A * 1/1995 Smith et al. ..... 338/308
5,907,274 A * 5/1999 Kimura et al. ..... 338/309

FOREIGN PATENT DOCUMENTS

JP 01-120801 5/1989
JP 06-20808 1/1994
JP 06-224014 8/1994
JP 06283301 A * 10/1994

OTHER PUBLICATIONS

Japanese search report for PCT/JP98/04427 dated Nov. 24, 1998.
English translation of Form PCT/ISA/210, no date.

* cited by examiner

*Primary Examiner*—Lincoln Donovan
*Assistant Examiner*—K. Lee
(74) *Attorney, Agent, or Firm*—RatnerPrestia

(57) ABSTRACT

The present invention relates to the resistors used for detecting current in a current-carrying circuit as a voltage, and aims to provides a resistor which assures highly accurate measurement of resistance even if the measuring point is not precisely placed. To obtain the above purpose, the resistor of the present invention comprises a sheet metal resistor element (11) and separate metal terminals (12),(13) electrically connected to both ends of the sheet resistor element(11). These terminals (12),(13) are made of metal having the same or greater electrical conductivity than that of the resistor element (11). With the above configuration, resistance of the terminals can be made smaller than that of the resistor element. This enables to reduce the proportion of resistance of the terminals in the entire resistor, allowing to ignore its effect on fluctuation of resistance due to deviation in measuring points of a resistance measuring terminal.

23 Claims, 19 Drawing Sheets

(a)

(b)

LOW-RESISTANCE RESISTOR AND ITS MANUFACTURING METHOD

This application is a U.S. National Phase Application of PCT International Application PCT/JP98/04427 filed on Oct. 1, 1998.

FIELD OF THE INVENTION

The present invention relates to the field of low-resistance resistors (hereafter referred to as "resistors") used for detecting current in a current-carrying circuit as a voltage, and their manufacturing method.

BACKGROUND OF THE INVENTION

The conventional resistor of this type is disclosed in Japanese Laid-open Patent Publication No. H6-20802.

A conventional resistor is described below with reference to drawings.

FIG. 29(*a*) is a perspective, and FIG. 29(*b*) is a sectional view of the conventional resistor.

In FIGS. 29(*a*) and (*b*), a resistor element 1 is a rectangular parallelepiped resistance metal made of an alloy of nickel, chromium, aluminum, and copper, and it has an integrated structure with opposing ends 2 and 3. A conductive material such as solder is coated on both ends 2 and 3 of the resistor element 1, typically by plating, to form terminals 4 and 5. A central portion 6 is the central area of the resistor element 1, excluding the terminals 4 and 5, and this central portion 6 is bent against the terminals 4 and 5 in order to create a gap between the resistor and a substrate when the resistor is mounted on the substrate. An insulating material 7 is provided on the central portion 6 of the resistor element 1.

A method for manufacturing the conventional resistor configured as above is described below.

FIGS. 30(*a*) to 30(*e*) are process charts illustrating the manufacturing method of the conventional resistor. In FIG. 30(*a*), the rectangular parallelepiped resistor element 1 having an integrated structure made of an alloy of nickel, chromium, aluminum, and copper with a predetermined resistance is formed.

In FIG. 30(*b*), a conductive material 8 is plated on the entire face of the resistor element 1 (not illustrated).

In FIG. 30(*c*), the conductive material 8 coated on the central portion 6 of the resistor element 1 is scraped off with a wire brush so as to expose the resistor element 1 at the central portion 6.

In FIG. 30(*d*), the terminals 4 and 5 disposed at the sides of the resistor element 1 are bent downward against the central portion 6 of the resistor element 1.

Lastly, in FIG. 30(*e*), the central portion 6 of the resistor element 1 is covered with an insulating material 7 by molding to complete the conventional resistor.

The above conventional resistor achieves the integrated structure of the resistor element 1 and terminals 4 and 5 by bending the resistance metal, and the resistor element 1 is made of an alloy of nickel, chromium, aluminum, and copper. The terminals 4 and 5 are configured by plating a conductive material such as solder on the surface of both ends 2 and 3.

The electrical conductivity of the alloy of nickel, chromium, aluminum, and copper configuring the resistor element 1 has lower electrical conductivity than metals generally having good conductivity such as copper, silver, gold, and aluminum. Since the base material of the terminals 4 and 5 is made of the same alloy as that of the resistor element 1, the base material configuring the terminals 4 and 5 has a larger resistance in proportion to its smaller electrical conductivity compared to metals generally having good conductivity. Accordingly, both ends 2 and 3 of the resistor element 1 are coated, such as by plating, with a conductive material such as solder in order to reduce resistance.

In the case of resistors having large resistance in the conventional configuration, resistance at the terminals 4 and 5 is reduced by coating a conductive material such as solder on the surface of both ends 2 and 3 of the resistor element 1, and thus the difference in resistance between the resistor element 1 and terminals 4 and 5 becomes extremely large. Consequently, the composite resistance of the resistor element 1 and terminals 4 and 5, which is the overall resistance of the resistor, may be represented by only the resistance of resistor element 1, allowing to ignore the resistance at the terminals 4 and 5.

However, in the case of resistors with a resistance of 0.1 ohms or below, the resistance of the terminals 4 and 5 in the entire resistor cannot be ignored. For accurate measurement of the resistance of a resistor with a high resistance, the four-probe method is generally used. However, for measuring the resistance of a resistor with a resistance of 0.1 ohms or below, the resistance varies according to the position of the probe contacting the terminals 4 and 5, even the four-probe method is used, because the resistance of the terminals 4 and 5 affect the resistance of the entire resistor with increasing resistance of the terminals 4 and 5. In this case, fluctuation in resistance due to deviation in the measuring point on the terminals 4 and 5 increases as the proportion of the resistance of the terminals 4 and 5 in the entire resistor increases. Accordingly, it is necessary to specify the measuring point for reproducing measurements with high accuracy in the conventional configuration. However, assuring the reproducibility of the same measuring point is extremely difficult even when the measuring point is specified, thus decreasing the reproducibility of the resistance measurements.

SUMMARY OF THE INVENTION

The present invention aims to address the above disadvantage of the prior art, and provides a resistor which assures highly accurate measurement of resistance even if the measuring point is not precisely placed.

To solve the aforementioned disadvantage of the conventional resistor, the resistor of the present invention comprises a sheet metal resistor element and separate metal terminals electrically connected to both ends of the sheet resistor element. These terminals are made of metal having the same or greater electrical conductivity than that of the resistor element. The terminals and the resistor element are connected through a third metal.

With the above configuration, resistance of the terminals can be made smaller than that of the resistor element because the terminals are made of a material having the same or greater electrical conductivity than that of the resistor element. This enables to reduce the proportion of resistance of the terminals in the entire resistor, allowing to ignore its effect on fluctuation of resistance due to deviation in measuring points of a resistance measuring terminal. The present invention can thus assure reproducibility of highly accurate measurement of resistance, providing the resistor which assures highly accurate measurement of resistance even if the measuring point is not precisely placed.

BRIEF DESCRIPTION OF THE DRAWINGS

FIG. 1(*b*) is a plan view of the resistor in accordance with the first exemplary embodiment of the present invention.

FIG. (*c*) is a side view of a terminal, a key part, of the resistor in accordance with the first exemplary embodiment of the present invention seen from an open side.

Figure 2:
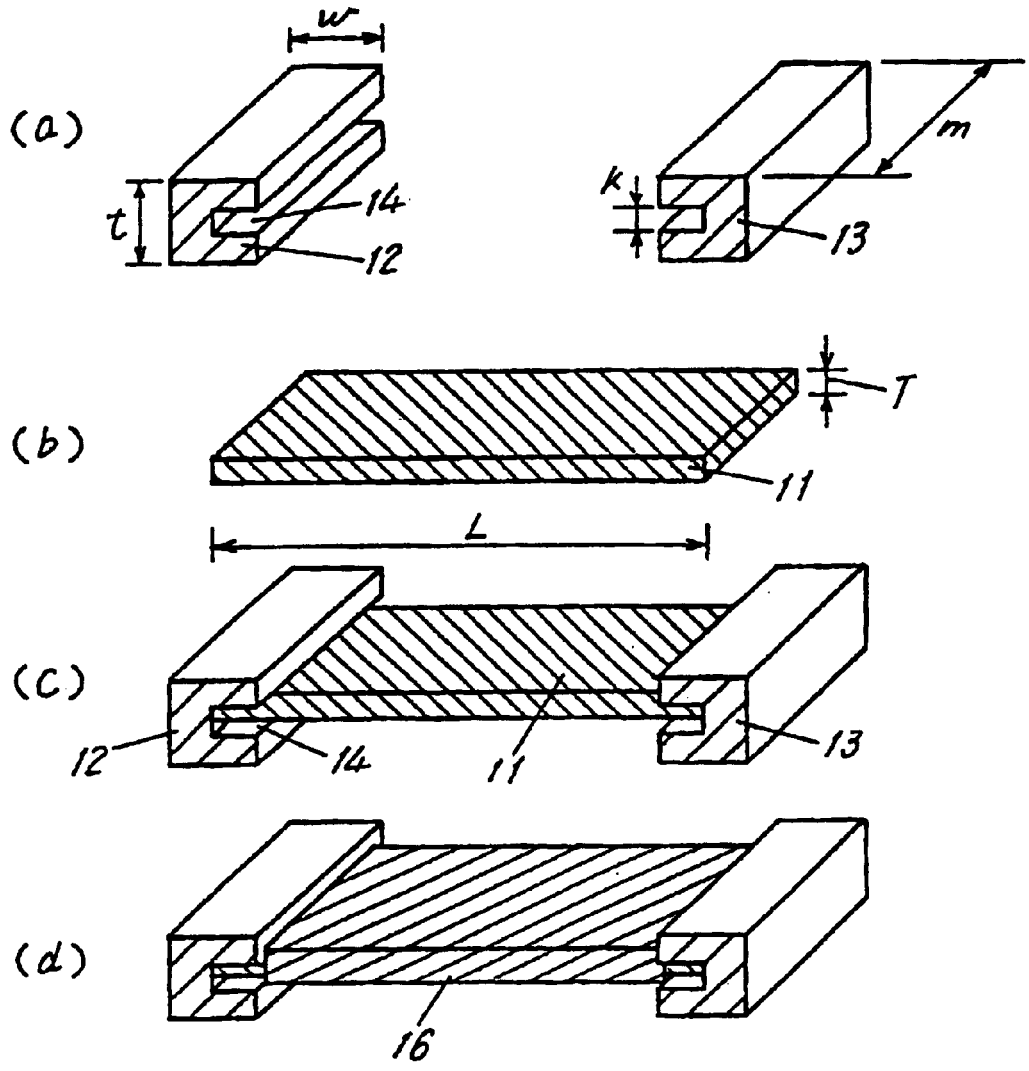

FIGS. 2(*a*) to 2(*d*) are process charts illustrating a method for manufacturing the resistor in accordance with the first exemplary embodiment of the present invention.

Figure 3:
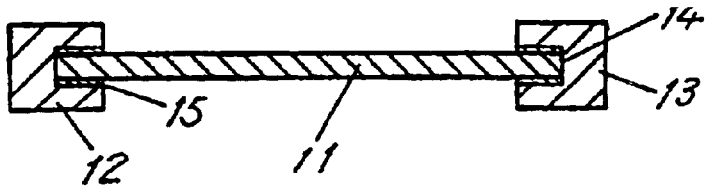

FIG. 3 is a sectional view of another example of the resistor in accordance with the first exemplary embodiment of the present invention.

Figure 4:
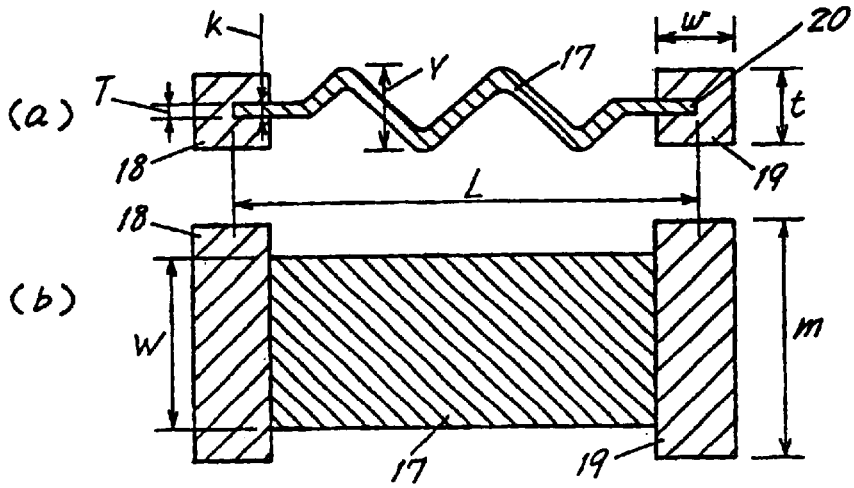

FIG. 4(*a*) is a sectional view of a resistor in accordance with a second exemplary embodiment of the present invention.

FIG. 4(*b*) is a plan view of the resistor in accordance with the second exemplary embodiment of the present invention.

Figure 5:
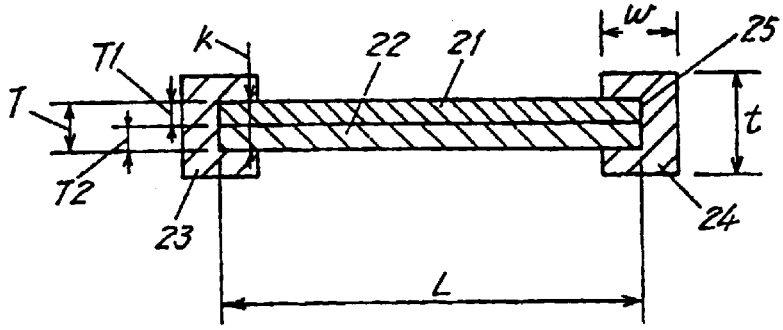

FIG. 5 is a sectional view of a resistor in accordance with a third exemplary embodiment of the present invention.

Figure 6:
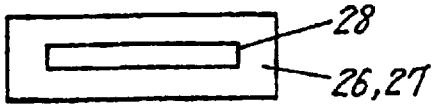

FIG. 6 is a side view of a terminal, a key part, of a resistor in accordance with a fourth exemplary embodiment of the present invention seen from an open side.

Figure 7:
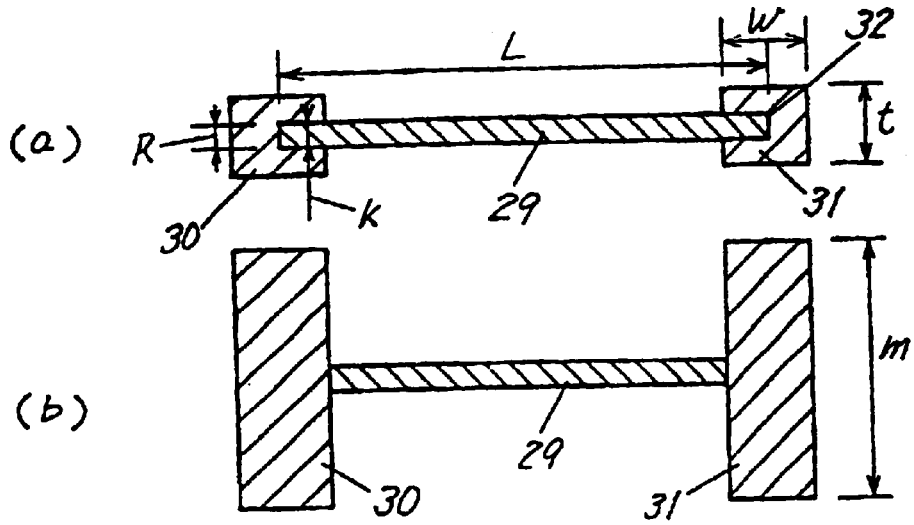

FIG. 7(*a*) is a sectional view of a resistor in accordance with a fifth exemplary embodiment of the present invention.

FIG. 7(*b*) is a plan view of the resistor in accordance with the fifth exemplary embodiment of the present invention.

Figure 8:
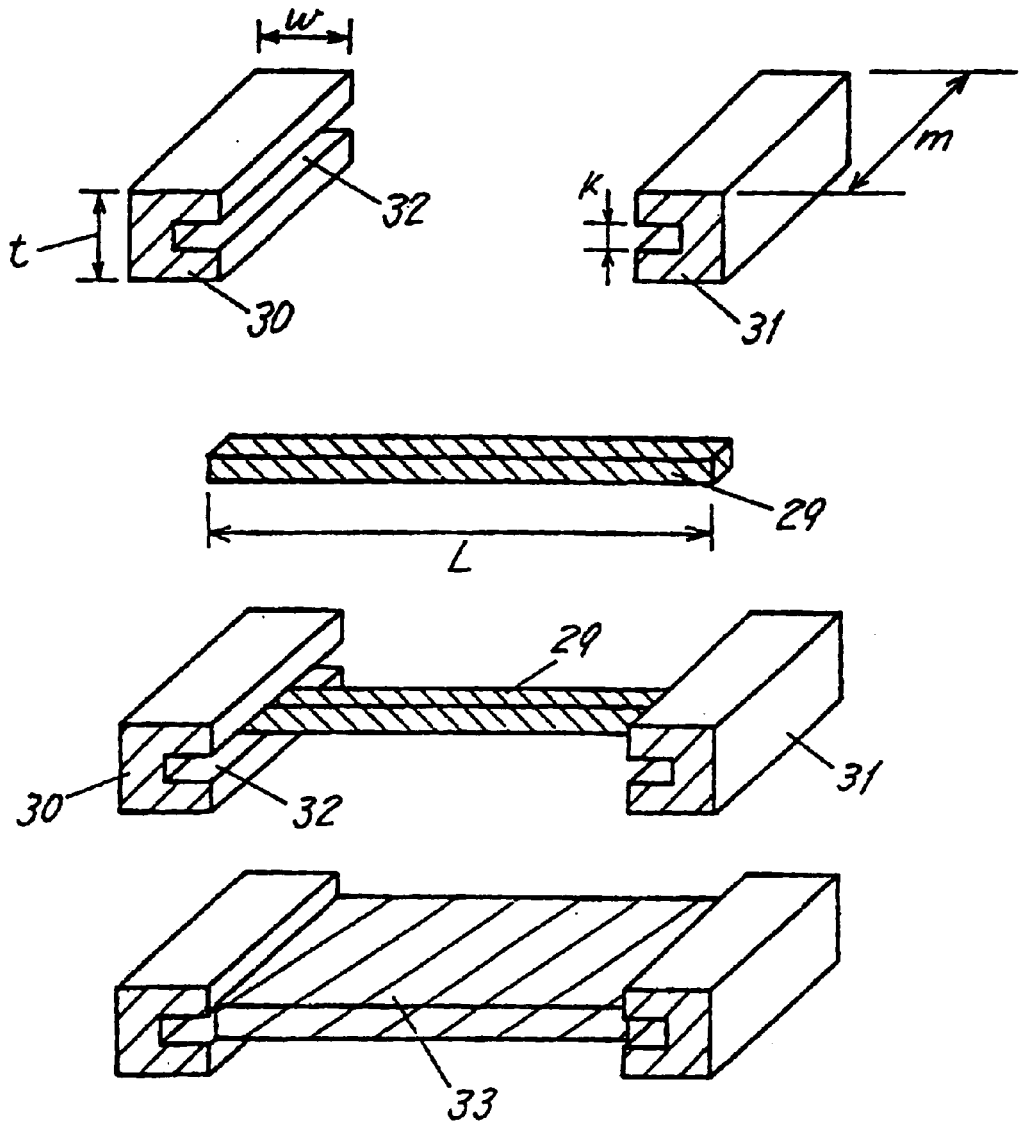

FIGS. 8(*a*) to 8(*d*) are process charts illustrating a method for manufacturing the resistor in accordance with the fifth exemplary embodiment of the present invention.

Figure 9:
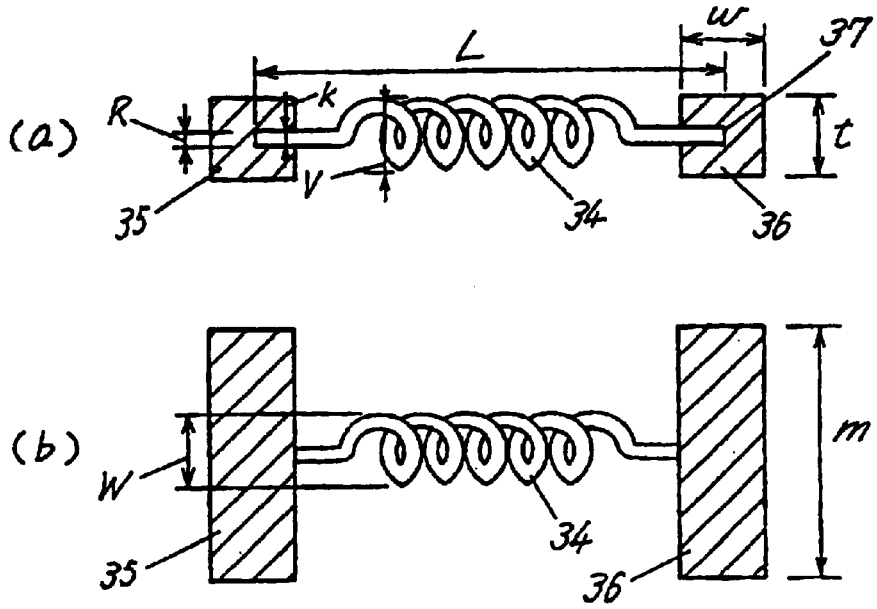

FIG. 9(*a*) is a sectional view of a resistor in accordance with a sixth exemplary embodiment of the present invention.

FIG. 9(*b*) is a plan view of the resistor in accordance with the sixth exemplary embodiment of the present invention.

Figure 10:
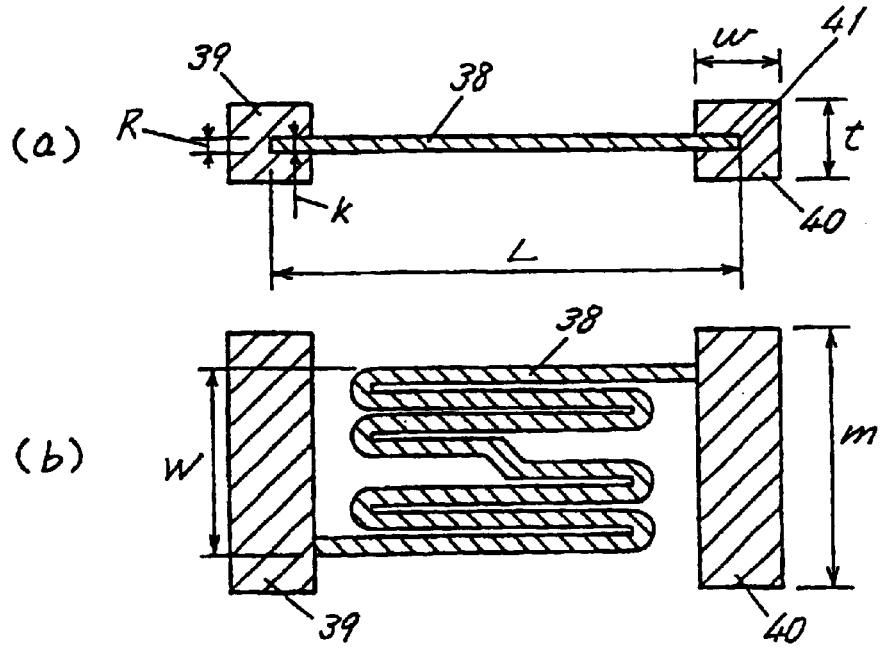

FIG. 10(*a*) is a sectional view of a resistor in accordance with a seventh exemplary embodiment of the present invention.

FIG. 10(*b*) is a plan view of the resistor in accordance with the seventh exemplary embodiment of the present invention.

Figure 11:
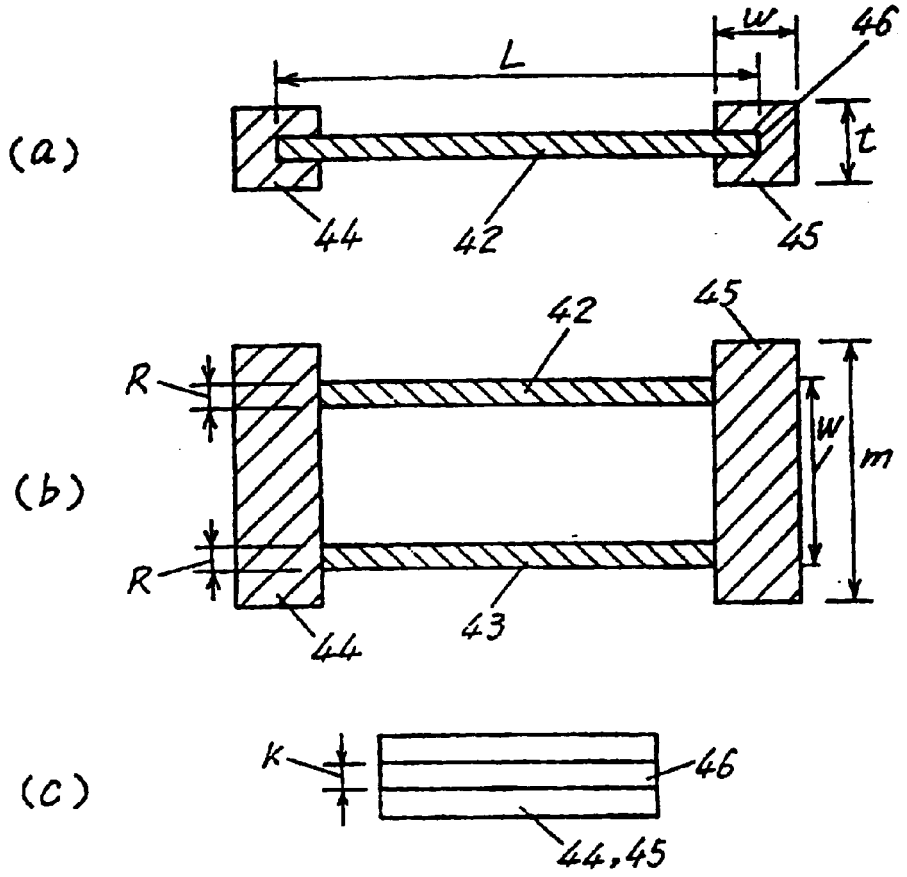

FIG. 11(*a*) is a sectional view of a resistor in accordance with an eighth exemplary embodiment of the present invention.

FIG. 11(*b*) is a plan view of the resistor in accordance with the eighth exemplary embodiment of the present invention.

FIG. 11(*c*) is a side view of a terminal, a key part, of the resistor in accordance with the eighth exemplary embodiment of the present invention seen from an open side.

Figure 12:
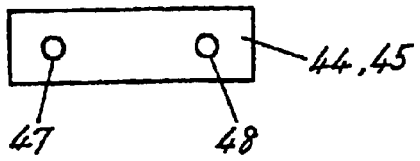

FIG. 12 is a side view of another example of a terminal of the resistor in accordance with the eighth exemplary embodiment of the present invention seen from an open side.

Figure 13:
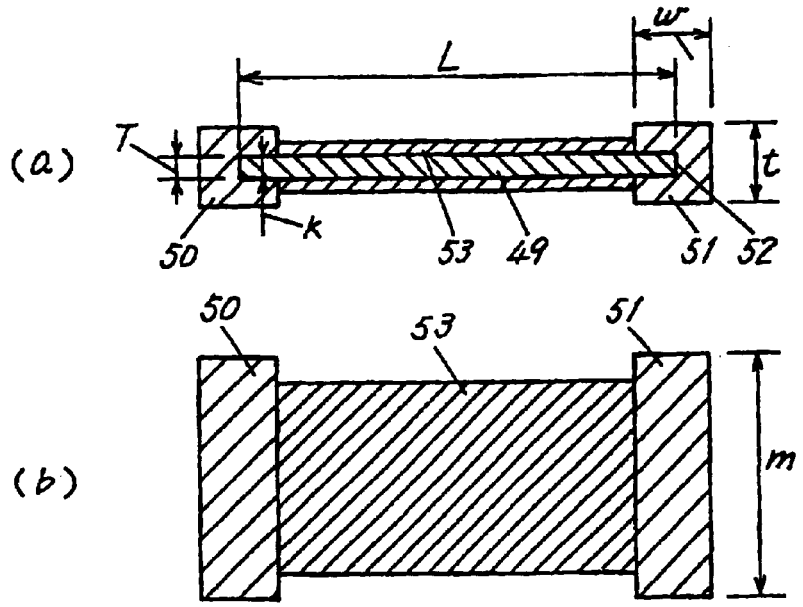

FIG. 13(*a*) is a sectional view of a resistor in accordance with a ninth exemplary embodiment of the present invention.

FIG. 13(*b*) is a plan view of the resistor in accordance with the ninth exemplary embodiment of the present invention.

Figure 14:
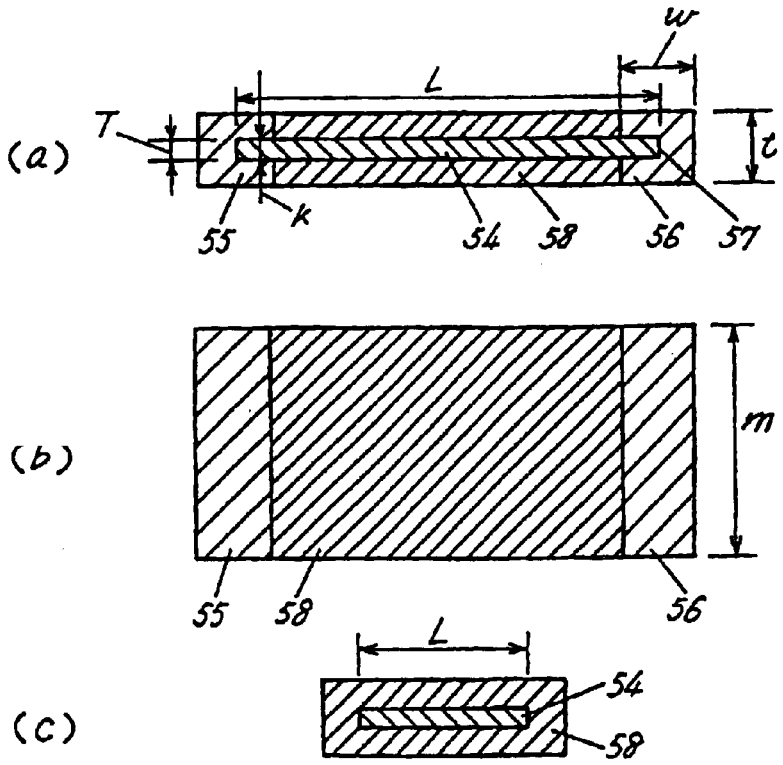

FIG. 14(*a*) is a sectional view of a resistor in accordance with a tenth exemplary embodiment of the present invention.

FIG. 14(*b*) is a plan view of the resistor in accordance with the tenth exemplary embodiment of the present invention.

FIG. 14(*c*) is a sectional view of a terminal cut widthwise of the resistor in accordance with the tenth exemplary embodiment of the present invention.

Figure 15:
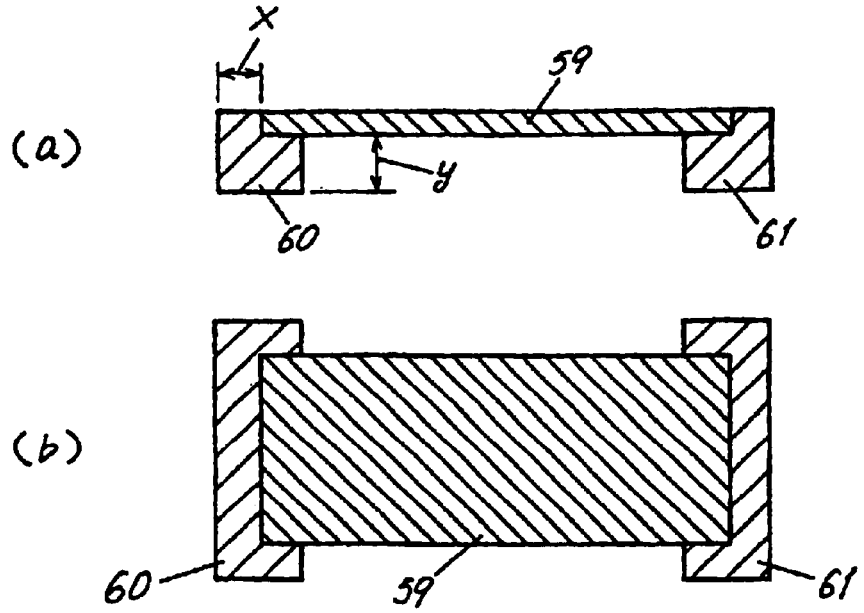

FIG. 15(*a*) is a sectional view of a resistor in accordance with an eleventh exemplary embodiment of the present invention.

FIG. 15(*b*) is a plan view of the resistor in accordance with the eleventh exemplary embodiment of the present invention.

Figure 16:
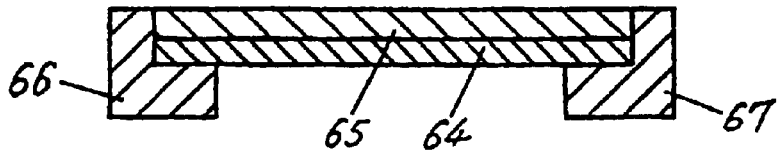

FIG. 16 is a sectional view of a resistor in accordance with a twelfth exemplary embodiment of the present invention.

Figure 17:
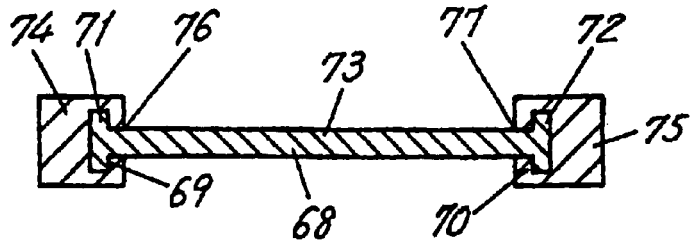

FIG. 17 is a sectional view of a resistor in accordance with a thirteenth exemplary embodiment of the present invention.

Figure 18:
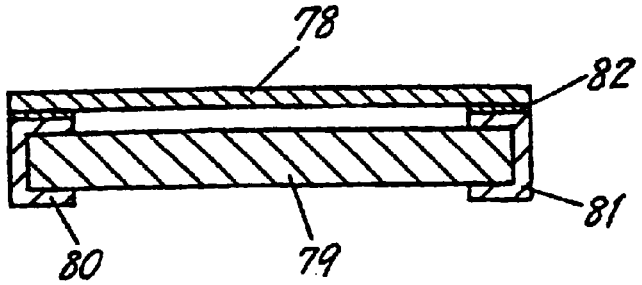

FIG. 18 is a sectional view of a resistor in accordance with a fourteenth exemplary embodiment of the present invention.

Figure 19:
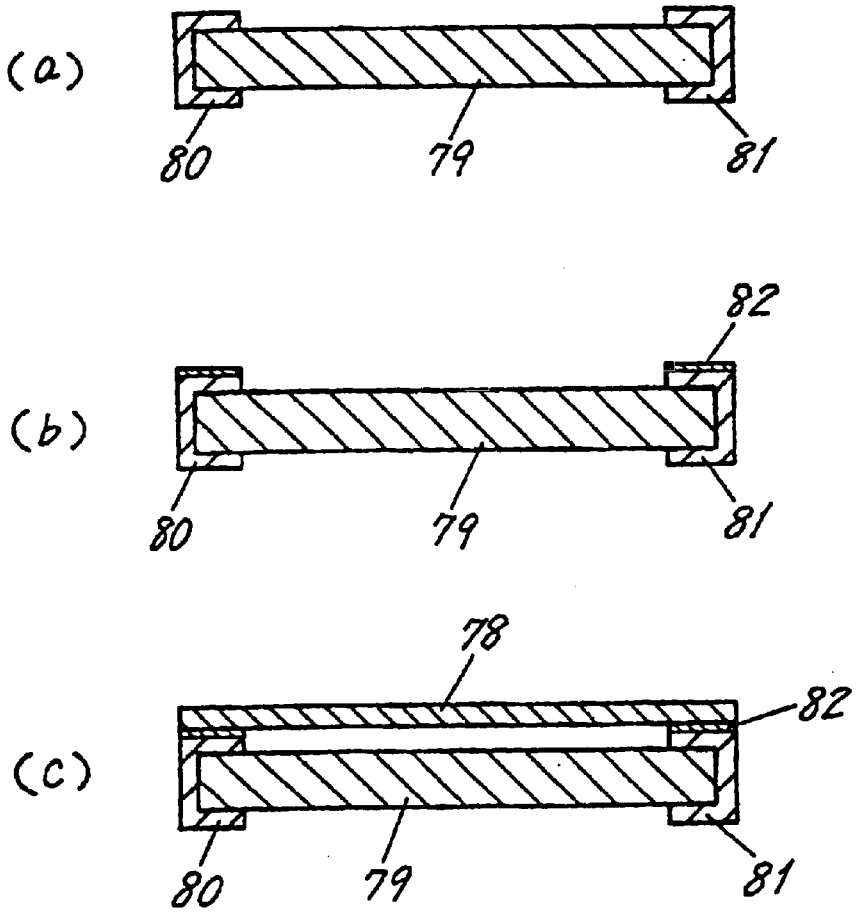

FIGS. 19(*a*) to 19(*c*) are process charts illustrating a method for manufacturing the resistor in accordance with the fourteenth exemplary embodiment of the present invention.

Figure 20:
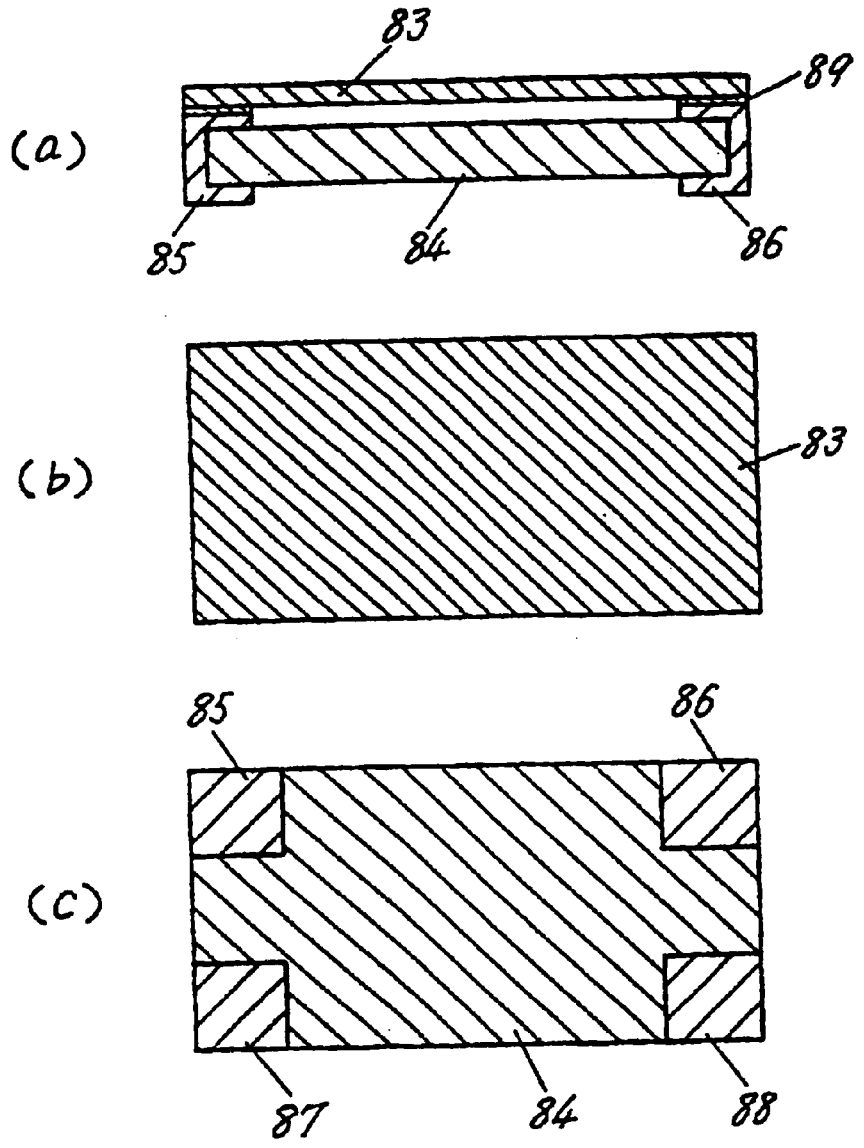

FIG. 20(*a*) is a sectional view of a resistor in accordance with a fifteenth exemplary embodiment of the present invention.

FIG. 20(*b*) is a plan view of a surface of the resistor in accordance with the fifteenth exemplary embodiment of the present invention.

FIG. 20(*c*) is a plan view of a rear face of the resistor in accordance with the fifteenth exemplary embodiment of the present invention.

Figure 21:
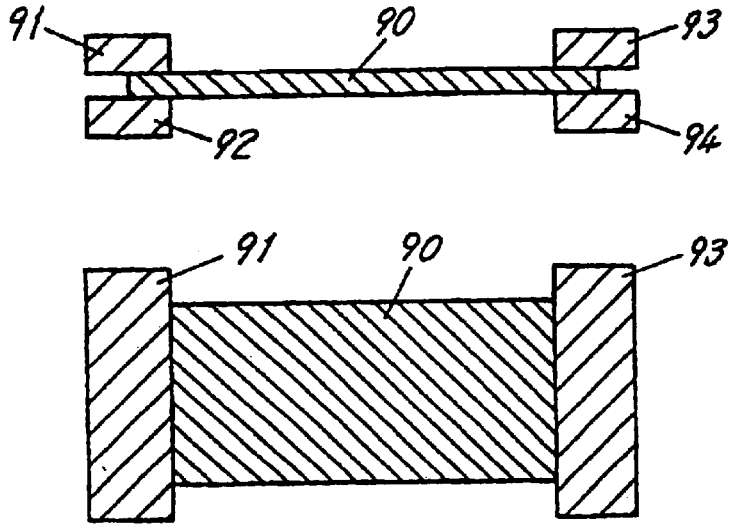

FIG. 21(*a*) is a sectional view of a resistor in accordance with a sixteenth exemplary embodiment of the present invention.

FIG. 21(*b*) is a plan view of the resistor in accordance with the sixteenth exemplary embodiment of the present invention.

Figure 22:
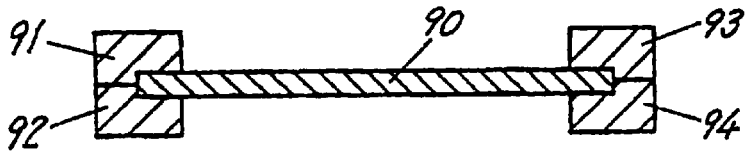

FIG. 22 is a sectional view of another example of the resistor in accordance with the sixteenth exemplary embodiment of the present invention.

Figure 23:
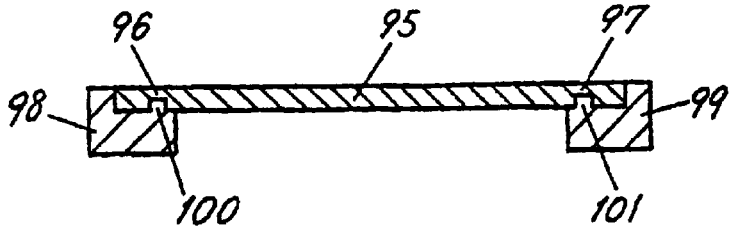

FIG. 23 is a sectional view of a resistor in accordance with a seventeenth exemplary embodiment of the present invention.

Figure 24:
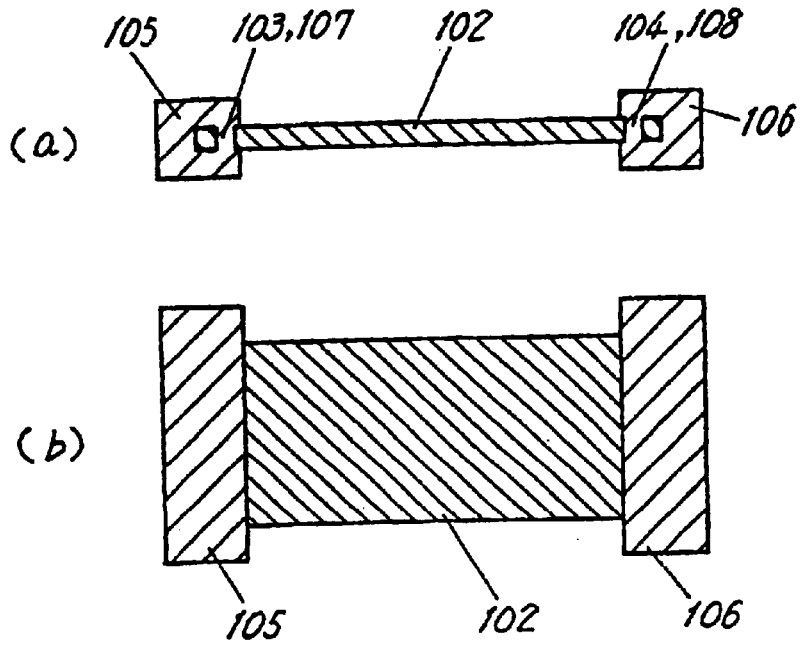

FIG. 24(*a*) is a sectional view of a resistor in accordance with an eighteenth exemplary embodiment of the present invention.

FIG. 24(*b*) is a plan view of the resistor in accordance with the eighteenth exemplary embodiment of the present invention.

Figure 25:
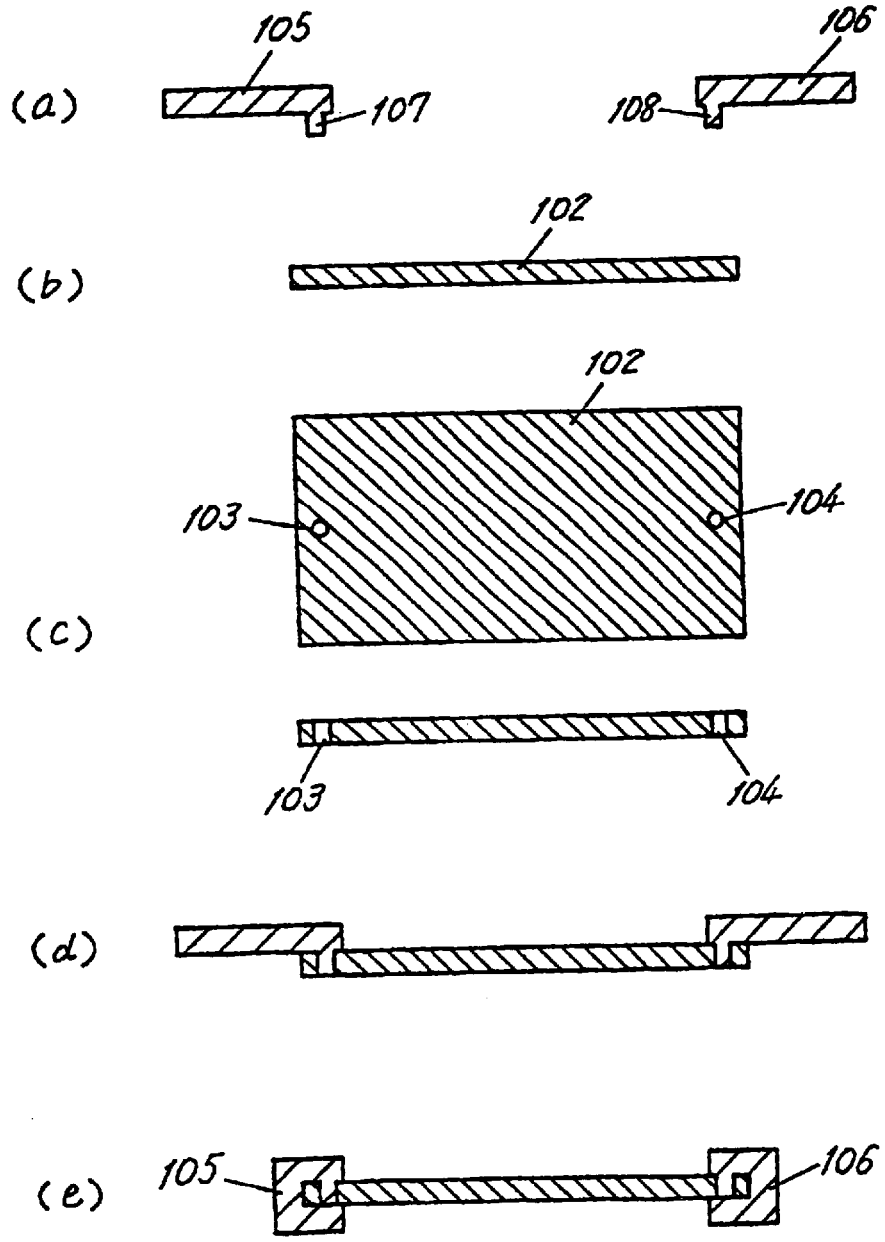

FIGS. 25(*a*) to 25(*e*) are process charts illustrating a method for manufacturing the resistor in accordance with the eighteenth exemplary embodiment of the present invention.

Figure 26:
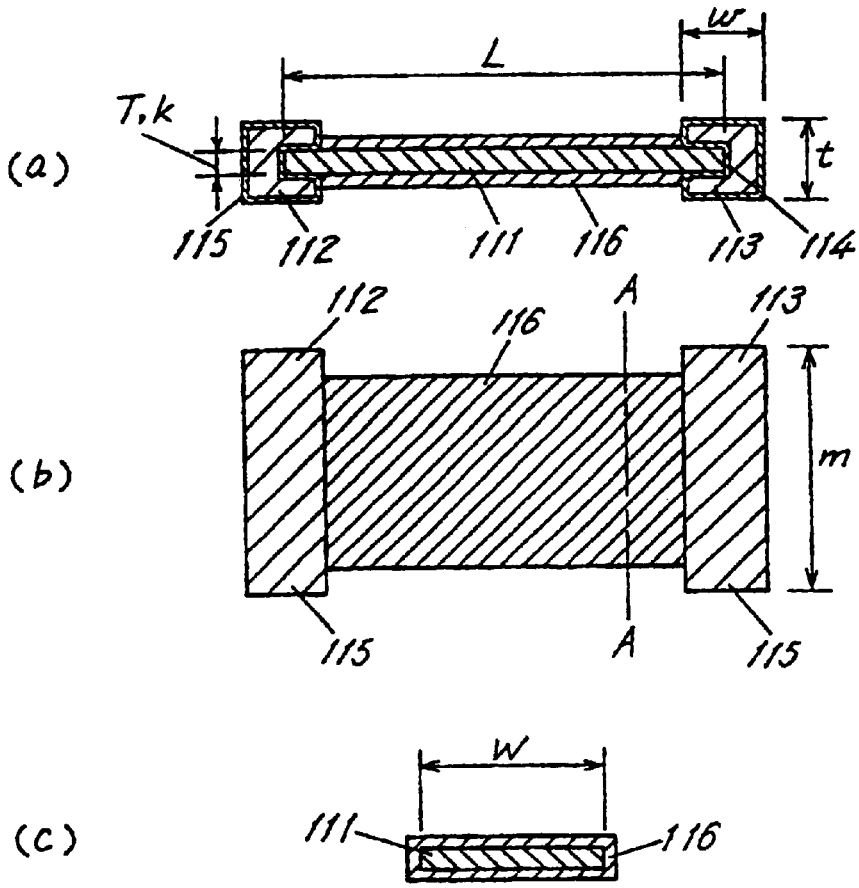

FIG. 26(*a*) is a sectional view of a resistor in accordance with a nineteenth exemplary embodiment of the present invention.

FIG. 26(*b*) is a plan view of the resistor in accordance with the nineteenth exemplary embodiment of the present invention.

FIG. 26(*c*) is a sectional view taken along Line A—A in FIG. 26(*b*).

Figure 27:
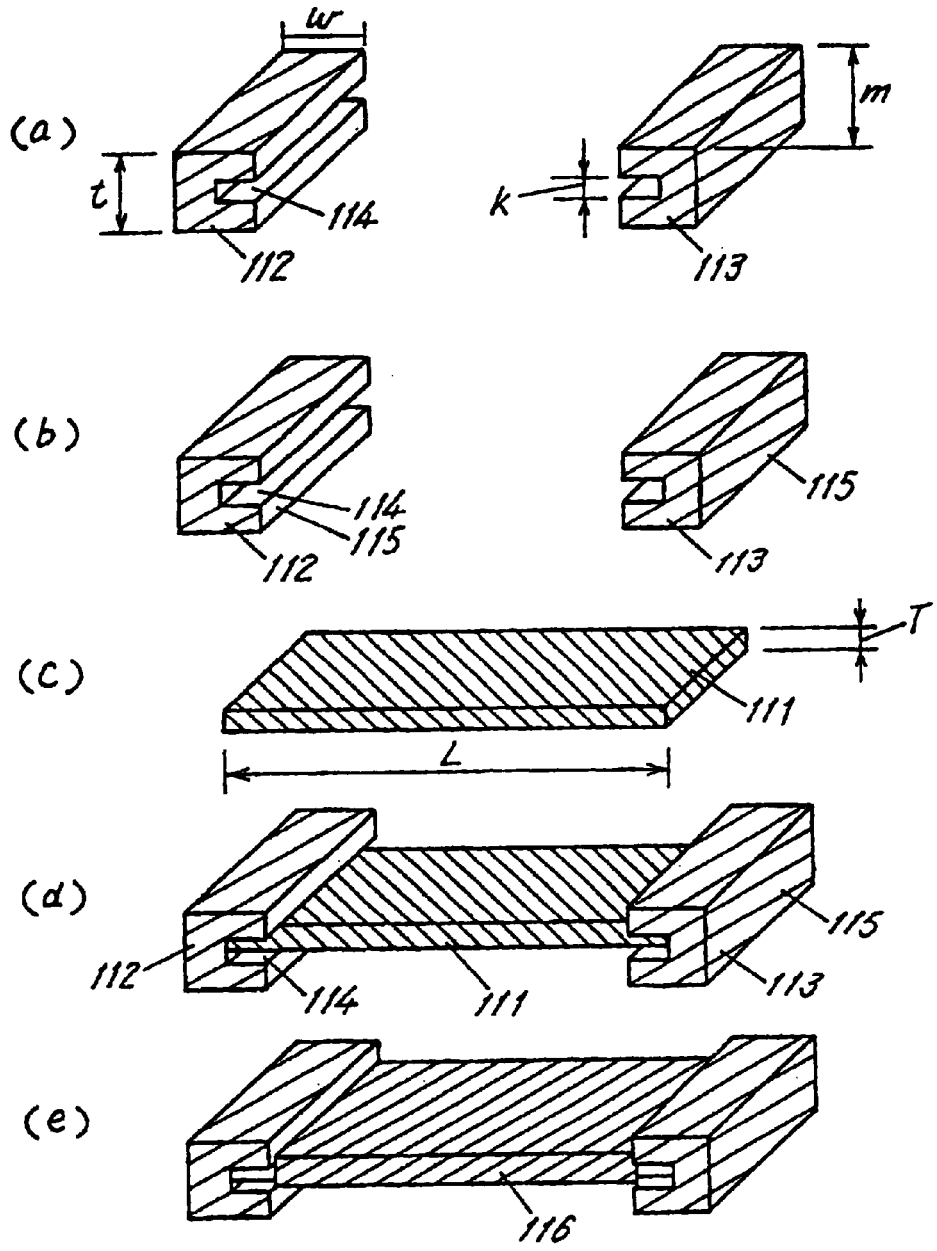

FIGS. 27(*a*) to 27(*e*) are process charts illustrating a method for manufacturing the resistor in accordance with the nineteenth exemplary embodiment of the present invention.

Figure 28:
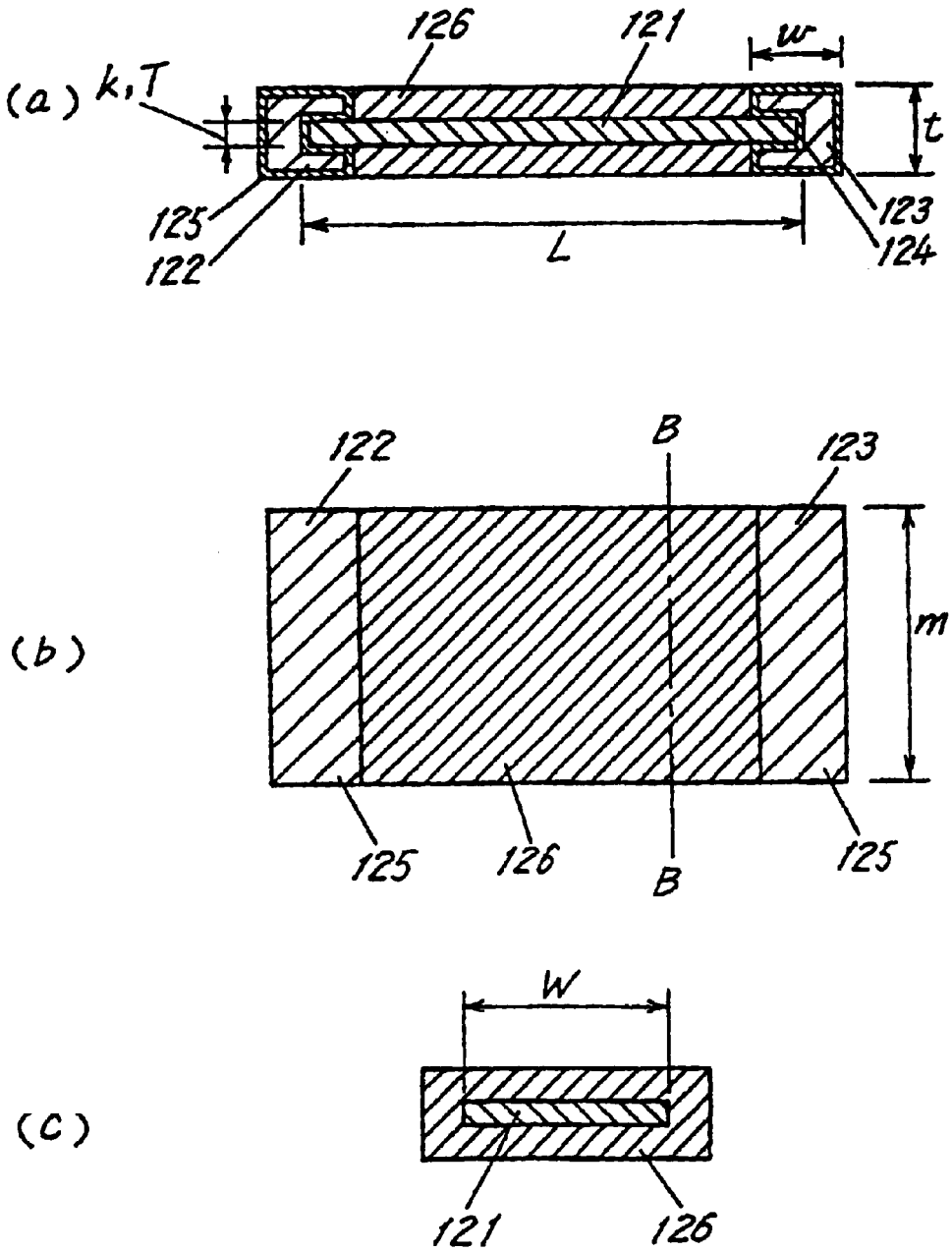

FIG. 28(*a*) is a sectional view of a resistor in accordance with a twentieth exemplary embodiment of the present invention.

FIG. 28(*b*) is a plan view of the resistor in accordance with the twentieth exemplary embodiment of the present invention.

FIG. 28(*c*) is a sectional view taken long Line B—B in FIG. 28(*b*).

Figure 29:
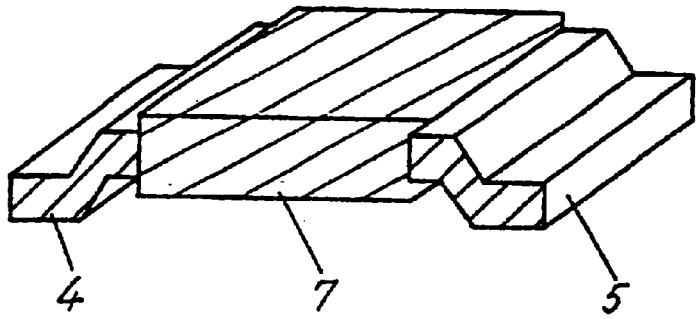
Figure 29:
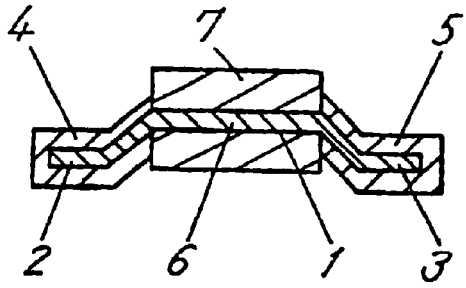

FIG. 29(*a*) is a perspective of a conventional resistor.

FIG. 29(*b*) is a sectional view of the conventional resistor.

Figure 30:
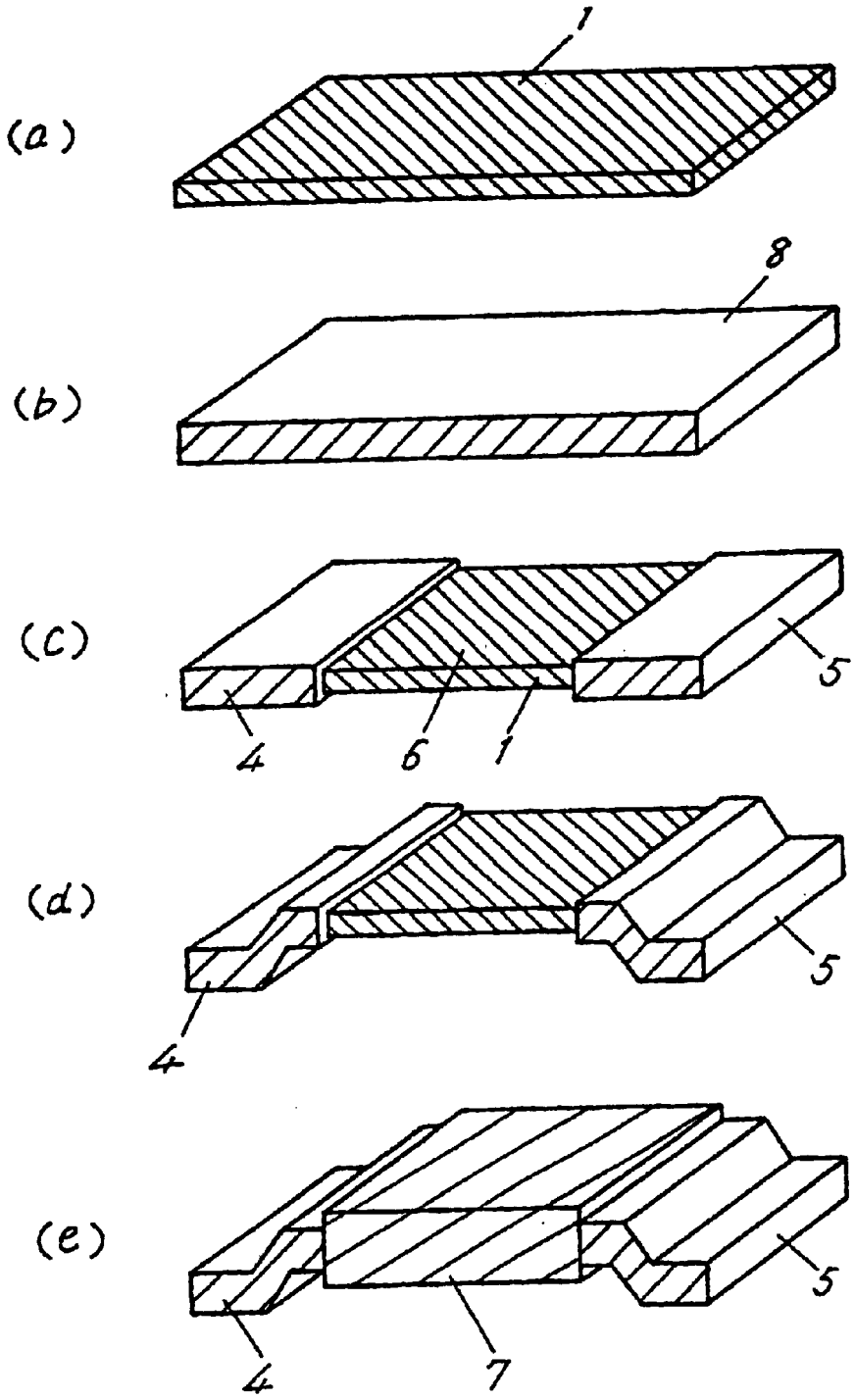

FIGS. 30(*a*) to 30(*e*) are process charts illustrating a method for manufacturing the conventional resistor.

DESCRIPTION OF THE PREFERRED EMBODIMENTS

First Exemplary Embodiment

A resistor in a first exemplary embodiment is described below with reference to drawings.

Figure 1:
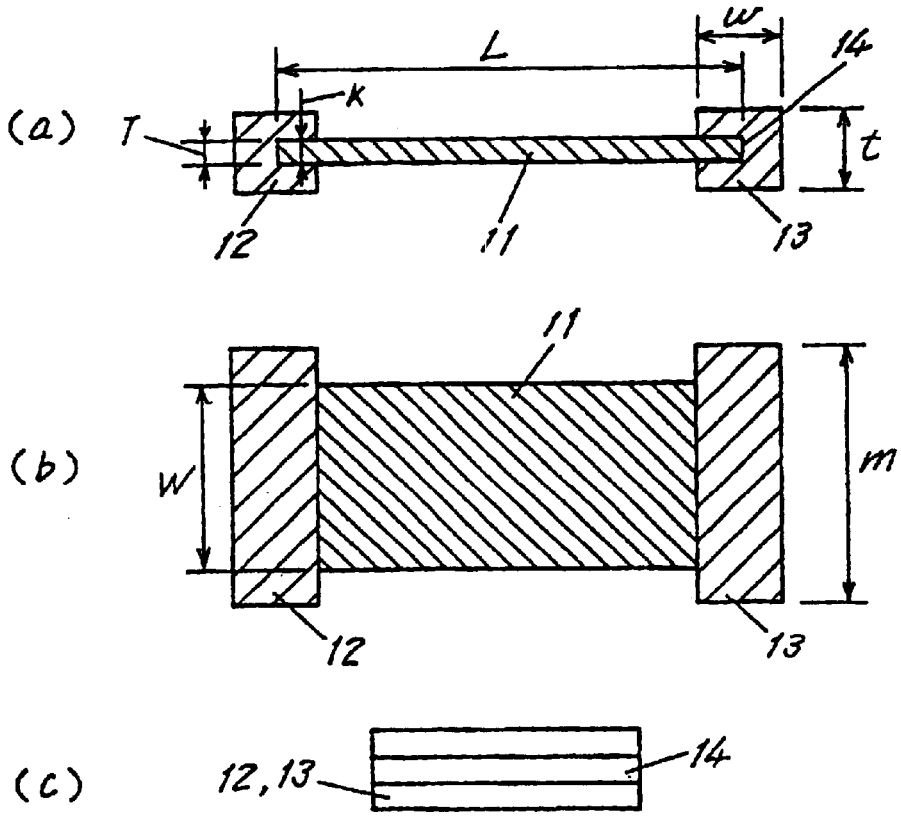
FIG. 1(*a*) is a sectional view of a resistor in accordance with a first exemplary embodiment of the present invention.

FIG. 1(*a*) is a sectional view of the resistor in the first exemplary embodiment of the present invention: FIG. 1(*b*) is a plan view of the resistor, and FIG. 1(*c*) is a side view of a terminal, a key part of the resistor, seen from the open side.

In FIGS. 1(*a*) to 1(*c*), a resistor element 11 is made such as of a sheet of copper-nickel alloy, nickel-chromium alloy, or copper-manganese-nickel alloy. First and second terminals 12 and 13 have a concave groove 14 of a width k which is equivalent to a thickness T of the resistor element 11, and are provided and electrically connected to both ends of the resistor element 11. The thickness t of these first and second terminals 12 and 13 is thicker than the thickness T of the resistor element 11; their width m is equivalent to or wider than the width W of the resistor element 11; and their length w is shorter than the length L of the resistor element 11. The first and second terminals 12 and 13 are made of metals such as copper, silver, gold, aluminum, copper nickel, or copper zinc with the same or greater electrical conductivity than that of the resistor element 11.

A manufacturing method of the resistor in the first exemplary embodiment of the present invention as configured above is described next with reference to drawings.

FIGS. 2(*a*) to 2(*d*) are process charts illustrating the manufacturing method of the resistor in the first exemplary embodiment of the present invention.

In FIG. 2(*a*), a metal sheet or metal strip such as of copper, silver, gold, aluminum, copper nickel, and copper zinc having electrical conductivity equivalent to or greater than the resistor element 11 (not illustrated) is formed into the first and second terminals 12 and 13 having the concave groove 14, using a range of processes including cutting, casting, forging, pressing, and drawing. The first and second terminals are formed in a way to achieve the next dimensions: Width k of the concave groove 14 equivalent to the thickness T of the resistor element 11, thickness t thicker than the thickness T of the resistor element 11, width m equivalent to or wider than the width W of the resistor element 11, and the length w shorter than the length L of the resistor element 11.

In FIG. 2(*b*), a metal sheet or metal strip such as of copper-nickel alloy, nickel-chromium alloy, or copper-manganese-nickel alloy is formed into the resistor element 11 having a predetermined sheet shape and predetermined resistance, calculated from the volume resisitivity, section area, and length, through a range of processes including cutting, punching, and pressing.

In FIG. 2(*c*), after fitting both ends of the resistor element 11 into the groove 14 of the first and second terminals 12 and 13, the first and second terminals 12 and 13 are heat pressed in the vertical direction (in the direction of holding the resistor element 11).

In FIG. 2(*d*), a protective film 16 made of a film such as of epoxy resin, polyimide resin, or poly-carbodiimide resin is cut into a predetermined shape by means of punching and pressing, and is placed on the top and bottom of the resistor element 11 (not illustrated). The protective film 16 is formed on the top, bottom, and side faces of the resistor element 11 by thermal compression bonding or ultrasonic welding to complete the resistor in the first exemplary embodiment of the present invention.

The direction of inserting both ends of the resistor element 11 into the groove 14 of the first and second terminals 12 and 13 may be from the open side of the first and second terminals 12 and 13 or from the side face of the first and second terminals 12 and 13.

For adjusting the resistance of the resistor in the first exemplary embodiment of the present invention, a through groove may be created on the resistor element 11 or a part of the surface and/or side face of the resistor element 11 may be cut by laser, punching, diamond wheel cutting, grinding, etching, or the like while measuring the resistance between predetermined points or calculating the required processing after measuring the resistance. The resistance may also be adjusted or corrected at the time of forming the resistor element 11.

If a material with a lower electrical conductivity than the resistor element 11 is used for the first and second terminals 12 and 13 in the resistor as manufactured above, deviations in the resistance due to variations in the position of measuring point are magnified, making it inappropriate for practical use. Accordingly, the first and second terminals 12 and 13 are made of a material having electrical conductivity equivalent to or greater than that of the resistor element 11.

Deviations in resistance due to the position of measuring point may also be reduced by making the thickness t of the first and second terminals 12 and 13 greater than the thickness T of the resistor element 11. In particular, the thickness t of the first and second terminals 12 and 13 may be required to be three times or more greater than the thickness T of the resistor element 11 to achieve allowable dispersion in resistance fully satisfying in-house specification.

FIG. 3 shows another example of a resistor in the first exemplary embodiment of the present invention.

In FIG. 3, a third conductive metal layer 15 is provided between the resistor element 11 and the first terminal 12 and between the resistor element 11 and the second terminal 13 to provide an electrical connection between the resistor element 11 and the first terminal 12, and between the resistor element 11 and the second terminal 13. For bonding the resistor element 11 and the first and second terminals 12 and 13, a range of methods may be used: (1) brazing after inserting a third conductive metal such as copper, silver, gold, tin, and solder between the resistor element 11 and the first and second terminals 12 and 13; (2) plating the resistor element 11 and first and second terminals 12 and 13, and thermal compression bonding after fitting the resistor element 11 into the first and second terminals 12 and 13; and (3) applying conductive paste to the resistor element 11 and the first and second terminals,and then thermosetting after fitting the resistor element 11 into the first and second terminals 12 and 13.

Second Exemplary Embodiment

A resistor in a second exemplary embodiment of the present invention is described below with reference to drawings.

FIG. 4(*a*) is a sectional view, and FIG. 4(*b*) is a plan view of the resistor in the second exemplary embodiment of the present invention.

In FIGS. 4(*a*) and 4(*b*), a resistor element 17, made typically of copper-nickel alloy, nickel-chromium alloy, or copper-manganese-nickel alloy, is corrugated in the thickness direction. First and second terminals 18 and 19 have a concave groove 20 of the width k which is equivalent to the thickness T of the resistor element 17, and are provided and electrically connected to both ends of the resistor element 17. The thickness t of these first and second terminals 18 and 19 is thicker than the total thickness V of the resistor element 17; their width m is equivalent to or wider than the width W of the resistor element 17; and their length w is shorter than the length L of the resistor element 17. The first and second terminals 18 and 19 are made of metals such as copper, silver, gold, aluminum, copper nickel, or copper zinc with the same or greater electrical conductivity than that of the resistor element 17.

A manufacturing method of the resistor in the second exemplary embodiment of the present invention as configured above is described next with reference to drawings.

The manufacturing method of the resistor in the second exemplary embodiment is the same as that described for the resistor in the first exemplary embodiment using FIG. 2. A metal sheet or strip such as of copper-nickel alloy, nickel-chromium alloy, or copper-manganese-nickel alloy is formed into the resistor element 11 having a predetermined sheet shape and predetermined resistance, calculated from the volume resistivity, section area, and length, through a range of processes including cutting, punching, and pressing. A detail which differs from the first exemplary embodiment is that, after forming the resistor element 11 as described above, a sheet of resistor element 11 is corrugated in the thickness direction in accordance with dimensions required for the resistor, so as to form the resistor element 17.

The resistance of the resistor in the second exemplary embodiment may be increased by bending the resistor element 17 in such a way that the length L of the resistor element 17 is increased in the longer side direction. On the other hand, the resistance of this resistor may be reduced by rotating it 90°, that is to bend it in a way so that its width W becomes longer.

When the resistor element 17 is bent in the width W direction, some other changes in its shape may be required. More specifically, the first and second terminals 18 and 19 may require a broader width k for the groove 20 to match the total thickness V in the bending direction of the resistor element 17. Or, the edge of the resistor element 17 may not be bent in order to fit the resistor element 17 into the original width k of the groove 20.

Third Exemplary Embodiment

A resistor in a third exemplary embodiment of the present invention is described below with reference to a drawing.

FIG. 5 is a sectional view of the resistor in the third exemplary embodiment of the present invention.

In FIG. 5, a resistor element 21 is made typically of copper-nickel alloy, nickel-chromium alloy, or copper-manganese-nickel alloy. An insulating sheet 22, made such as of alumina, glass, glass fiber impregnated epoxy resin, or paper impregnated phenolic resin, has the same dimensions as the top or bottom face of the resistor element 21, and is disposed at least on the top or bottom face of the resistor element 21. First and second terminals 22 and 23 have a concave groove 25 of the width k which is equivalent to the sum T of the thickness $T_1$ of the resistor element 21 and the thickness $T_2$ of the insulating sheet 22, and are provided and electrically connected to both ends of the resistor element 21. The thickness t of these first and second terminals 18 and 19 is thicker than the sum T of the thickness $T_1$ of the resistor element 21 and the thickness $T_2$ of the insulating sheet 22; their width m is equivalent to or wider than the width W of the resistor element 21; and their length w is shorter than the length L of the resistor element 21. The first and second terminals 23 and 24 are made of metals such as copper, silver, gold, aluminum, copper nickel, or copper zinc with the same or greater electrical conductivity than that of the resistor element 21.

A manufacturing method of the resistor in the third exemplary embodiment of the present invention as configured above is described next with reference to drawings.

The manufacturing method of the resistor in the third exemplary embodiment is substantially the same as that described for the resistor in the first exemplary embodiment using FIG. 2. A metal sheet or metal strip such as of copper-nickel alloy, nickel-chromium alloy, or copper-manganese-nickel alloy is formed into the resistor element 21 having a predetermined sheet shape and predetermined resistance, calculated from the volume resistivity, section area, and length, through a range of processes including cutting, punching, and pressing. A detail which differs from the first exemplary embodiment is that, after forming the resistor element 21 as described above, the insulating sheet 22 made such as of alumina, glass, glass impregnated epoxy resin, or paper impregnated phenolic resin having the same two-dimensional size as the resistor element 21 is made such as by dividing, cutting, punching, and pressing, and then attached to the resistor element 21.

Processes and materials for manufacturing the first and second terminals 23 and 24 are the same as those indicated in FIG. 2(*a*). However, the thickness t and groove width k of the first and second terminals 23 and 24 differ for the thickness of the insulating sheet 22.

Fourth Exemplary Embodiment

A resistor in a fourth exemplary embodiment of the present invention is described with reference to drawings.

FIG. 6 is a side view of a terminal, a key part, of the resistor in the fourth exemplary embodiment of the present invention seen from an open side.

In FIG. 6, first and second terminals 26 and 27 have a cavity 28 of the same shape as a section face in the width direction of the resistor element 11. The thickness t of these first and second terminals 26 and 27 is thicker than the thickness T of the resistor element 11; their width m is equivalent to or wider than the width W of the resistor element 11; and their length w is shorter than the length L of the resistor element 11. The first and second terminals 26 and 27 are made of metals such as copper, silver, gold, aluminum, copper nickel, or copper zinc with the same or greater electrical conductivity than that of the resistor element 11.

Fifth Exemplary Embodiment

A resistor in a fifth exemplary embodiment of the present invention is described with reference to drawings.

FIG. 7(*a*) is a sectional view, and FIG. 7(*b*) is a plan view of the resistor in the fifth exemplary embodiment of the present invention In FIGS. 7(*a*) and 7(*b*), a resistor element 29 is made such as of a copper-nickel alloy wire, nickel-chromium wire, or copper-manganese-nickel alloy wire.

First and second terminals 30 and 31 have a concave groove 32 of the width k which is equivalent to a diameter R of the resistor element 29, and are provided and electrically connected to both ends of the resistor element 29. The thickness t of these first and second terminals 30 and 31 is thicker than the resistor element 29; their width m is equivalent to or greater than the diameter R of the resistor element 29; and their length w is shorter than the length L of the resistor element 29. The first and second terminals 30 and 31 are made of metals such as copper, silver, gold, aluminum, copper nickel, or copper zinc with the same or greater electrical conductivity than that of the resistor element 29.

A method for manufacturing the resistor in the fifth exemplary embodiment of the present invention as configured above is described next with reference to drawings.

FIGS. 8(*a*) to 8(*d*) are process charts illustrating the manufacturing method of the resistor in the fifth exemplary embodiment of the present invention.

In FIG. 8(*a*), a metal wire made such as of copper, silver, gold, aluminum, copper nickel, or copper zinc which have the same or greater electrical conductivity than that of the resistor element 29 (not illustrated) is ground, cast, forged, pressed, and drawn to form the first and second terminals 30 and 31 having the groove 32 of the width k equivalent to the diameter R of the resistor element 29. The first and second terminals 30 and 31 are formed in a way to achieve the next dimensions: thickness t thicker than that of the resistor element 29, the width m same or greater than the diameter R of the resistor element 29, and length w shorter than the length L of the resistor element 29.

In FIG. 8(*b*), a metal wire such as of copper-nickel alloy, nickel-chromium alloy, or copper-manganese-nickel alloy is cut into the resistor element 29 having a predetermined sheet shape and predetermined resistance, calculated from the volume resistivity, section area, and length.

In FIG. 8(*c*), both ends of the resistor element 29 is fitted to the groove 32 of the first and second terminals 30 and 31, and they are thermally pressed in the vertical direction of the terminal (direction of holding the resistor element).

In FIG. 8(*d*), a protective film 33 made such as of a film of epoxy resin, polyimide resin, or poly-carbodiimide resin is cut, punched, or pressed into a predetermined shape, placed over and below the resistor element 29 (not illustrated). The protective film 33 is formed on the top, bottom, and side faces of the resistor element 29 by thermal compression bonding or ultrasonic welding to complete the resistor in the fifth exemplary embodiment.

Both ends of the resistor element 29 may be inserted to the groove 32 of the first and second terminals 30 and 31 from the open side or from the side face of the first and second terminals 30 and 31.

For bonding the resistor element 29 and the first and second terminals 30 and 31, a range of methods may be used: (1) brazing after inserting a third conductive metal such as copper, silver, gold, tin, or solder between the resistor element 29 and the first and second terminals 30 and 31; (2) plating and thermal compression bonding the resistor element 29 and first and second terminals 30 and 31; and (3) applying conductive paste to the resistor element 29 and the first and second terminals 30 and 31, and then thermosetting after fitting the resistor element 29 into the first and second terminals 30 and 31

For adjusting the resistance of the resistor in the fifth exemplary embodiment of the present invention, a through groove may be created on the resistor element 29 or a part of the surface and/or side face of the resistor element 29 may be cut by laser, punching, diamond wheel cutting, grinding, etching, or the like while measuring the resistance between predetermined points or calculating required processing after measuring the resistance. The resistance may also be adjusted or corrected at the time of forming the resistor element 29.

Sixth Exemplary Embodiment

A resistor in a sixth exemplary embodiment of the present invention is described with reference to drawings.

FIG. 9(*a*) is a sectional view, and FIG. 9(*b*) is a plan view of the resistor in the sixth exemplary embodiment of the present invention.

In FIGS. 9(*a*) and 9(*b*), a resistor element 34 is typically made of a copper-nickel alloy wire, nickel-chromium wire, or copper-manganese-nickel alloy wire bent into a cylindrical coil shape.

First and second terminals 35 arid 36 have a concave groove 37 of the width k which is equivalent to the diameter R of the resistor element 34, and are provided and electrically connected to both ends of the resistor element 34. The thickness t of these first and second terminals 35 and 36 is thicker than the total thickness V of the resistor element 34; their width m is equivalent to or wider than the width W of the resistor element 34; and their length w is shorter than the length L of the resistor element 34. The first and second terminals 35 and 36 are made of metals such as copper, silver, gold, aluminum, copper nickel, or copper zinc with the same or greater electrical conductivity than that of the resistor element 34.

A method for manufacturing the resistor in the sixth exemplary embodiment of the present invention as configured above is described next with reference to drawings.

The manufacturing method of the resistor in the sixth exemplary embodiment is the same as that described for the resistor in the fifth exemplary embodiment using FIG. 8. A metal wire such as of copper-nickel alloy, nickel-chromium alloy, or copper-manganese-nickel alloy is formed into the resistor element 29 having a predetermined wire shape and predetermined resistance, calculated from the volume resistivity, section area, and length, through a range of processes including dividing, cutting, and pressing. A detail which differs from the fifth exemplary embodiment is that, after forming the resistor element 29 as described above, a resistor element wire 29 is bent into a cylindrical coil shape, so as to form the resistor element 34.

Seventh Exemplary Embodiment

A seventh exemplary embodiment of the present invention is described with reference to drawings.

FIG. 10(*a*) is a sectional view, and FIG. 10(*b*) is a plan view of a resistor in the seventh exemplary embodiment of the present invention.

In FIGS. 10(*a*) and 10(*b*), a resistor element 38, made such as of copper-nickel alloy, nickel-chromium alloy, or copper-manganese-nickel alloy, is bent symmetrically to the left and right in one plane. First and second terminals 39 and 40 have a concave groove 41 of the width k which is equivalent to the diameter R of the resistor element 38, and are provided and electrically connected to both ends of the resistor element 38. The thickness t of these first and second terminals 39 and 40 is greater than the diameter R of the resistor element 38; their width m is equivalent to or wider than the width W of the resistor element 38; and their length w is shorter than the length L of the resistor element 38. The first and second terminals 39 and 40 are made of metals such as copper, silver, gold, aluminum, copper nickel, or copper zinc with the same or greater electrical conductivity than that of the resistor element 38.

A manufacturing method of the resistor in the seventh exemplary embodiment of the present invention as configured above is described next with reference to drawings.

The manufacturing method of the resistor in the seventh exemplary embodiment is the same as that described for the resistor in the fifth exemplary embodiment using FIG. 8. A metal wire such as of copper-nickel alloy, nickel-chromium alloy, or copper-manganese-nickel alloy is formed into the resistor element 29 having a predetermined wire shape and predetermined resistance, calculated from the volume resistivity, section area, and length, through a range of processes including dividing, cutting, and pressing. A detail which differs from the fifth exemplary embodiment is that after forming the resistor element 29 as described above, a resistor element wire 9 is bent symmetrically to the left and right in one plane in accordance with dimensions required for the resistor, so as to form the resistor element 38.

Eighth Exemplary Embodiment

A resistor in an eighth exemplary embodiment of the present invention is described below with reference to drawings.

FIG. 11(*a*) is a sectional view, FIG. 11(*b*) is a plan view, and FIG. 11(*c*) is a sectional view of a terminal, a key part, of the resistor in the eighth exemplary embodiment of the present invention.

In FIGS. 11(*a*) to 11(*c*), first and second resistor elements 42 and 43 are made typically of a copper-nickel alloy wire, nickel-chromium wire, or copper-manganese-nickel alloy wire. First and second terminals 44 and 45 have a concave groove 46 of the width k which is equivalent to the diameter R of the resistor elements 42 and 43, and are provided and electrically connected to both ends of the resistor elements 42 and 43. The thickness t of these first and second terminals 44 and 45 is thicker than that of the resistor elements 42 and 43; their width m is equivalent to or wider than the width W of the resistor elements 42 and 43; and their length w is shorter than the length L of the resistor elements 42 and 43. The first and second terminals 44 and 45 are made of metals such as copper, silver, gold, aluminum, copper nickel, or copper zinc with the same or greater electrical conductivity than that of the resistor elements 42 and 43.

A method for manufacturing of the resistor in the eighth exemplary embodiment of the present invention as configured above is described next with reference to drawings.

The manufacturing method of the resistor in the eighth exemplary embodiment is the same as that described for the resistor in the fifth exemplary embodiment using FIG. 8. A metal wire such as of copper-nickel alloy, nickel-chromium alloy, or copper-manganese-nickel alloy is formed into a plurality of resistor elements 42 and 43 having a predetermined wire shape and predetermined resistance, calculated from the volume resistivity, section area, and length, through a range of processes including cutting, punching, and pressing. A detail which differs from the fifth exemplary embodiment is that, after forming the resistor elements 42 and 43 as described above, these resistor elements 42 and 43 are connected to the first and second terminals 44 and 45 in a way that the resistor elements 42 and 43 do not directly and electrically contact each other.

FIG. 12 is a side view of a terminal in another example of the resistor in the eighth exemplary embodiment of the present invention.

In FIG. 12, first and second cavities 47 and 48 have a section shape equivalent to the first and second resistor elements 42 and 43 and are formed respectively on the first and second terminals 44 and 45 instead of the concave groove 46 of the width k equivalent to the diameter R of the resistor elements 42 and 43 shown in FIG. 11.

Ninth Exemplary Embodiment

A resistor in a ninth exemplary embodiment of the present invention is described below with reference to drawings.

FIG. 13(*a*) is a sectional view, and FIG. 13(*b*) is a plan view of the resistor in the ninth exemplary embodiment of the present invention.

In FIGS. 13(*a*) and 13(*b*), a resistor element 49 is made typically a sheet or strip of copper-nickel alloy, nickel-chromium alloy, or copper-manganese-nickel alloy. First and second terminals 50 and 51 have a concave groove 52 of the width k which is equivalent to the total thickness T of the resistor element 49, and are provided and electrically connected to both ends of the resistor element 49. The thickness t of these first and second terminals 50 and 51 is thicker than the total thickness T of the resistor element 49; their width m is equivalent to or wider than the width W of the resistor element 49; and their length w is shorter than the length L of the resistor element 49. The first and second terminals 50 and 51 are made of metals such as copper, silver, gold, aluminum, copper nickel, or copper zinc with the same or greater electrical conductivity than that of the resistor element 49. A protective film 53, made such as of epoxy resin, polyimide resin, or poly-carbodiimide resin is formed on the resistor element 49 at an area not connected to the first and second terminals 50 and 51.

A manufacturing method of the resistor in the ninth exemplary embodiment of the present invention as configured above is described next with reference to drawings.

The manufacturing method of the resistor in the ninth exemplary embodiment is basically the same as that described for the resistor in the first exemplary embodiment using FIG. 2. More specifically, a film of epoxy resin, polyimide resin, poly-carbodiimide resin, or the like is disposed to vertically sandwich the resistor element 49, and the protective film 53 is formed on the top, bottom, and side faces of the resistor element 49 by thermal compression bonding or ultrasonic welding, regardless of the shape of the resistor element, to complete the resistor in the ninth exemplary embodiment of the present invention.

Tenth Exemplary Embodiment

A resistor in a tenth exemplary embodiment of the present invention is described below with reference to drawings.

FIG. 14(*a*) is a sectional view, FIG. 14(*b*) is a plan view, and FIG. 14 8*c*) is a sectional view of a terminal, cut in a width m direction, of the resistor in the tenth exemplary embodiment of the present invention.

In FIGS. 14(*a*) to 14(*c*), a resistor element 54 is made typically of a shape or a strip of copper-nickel alloy, nickel-chromium alloy, or copper-manganese-nickel alloy. First and second terminals 55 and 56 have a concave groove 57 of the width k which is equivalent to the total thickness T of the resistor element 54, and are provided and electrically connected to both ends of the resistor element 54. The thickness t of these first and second terminals 55 and 56 is thicker than the total thickness T of the resistor element 54; their width m is equivalent to or wider than the width W of the resistor element 54; and their length w is shorter than the length L of the resistor element 54. The first and second terminals 55 and 56 are made of metals such as copper, silver, gold, aluminum, copper nickel, or copper zinc with the same or greater electrical conductivity than that of the resistor element 54. A protective film 58, made such as of epoxy resin, polyimide resin, or poly-carbodiimide resin, is formed on the resistor element 54 at an area not connected to the first and second terminals 55 and 56 to achieve the same dimensions as the width m and thickness t of the first and second terminals 55 and 56.

A method for manufacturing the resistor in the tenth exemplary embodiment of the present invention as configured above is basically the same as that described for the resistor in the first exemplary embodiment using FIG. 2. More specifically, a film of epoxy resin, polyimide resin, poly-carbodiimide resin, or the like is disposed to vertically sandwich the resistor element 54, and the protective film 58 is formed on the top, bottom, and side faces of the resistor element 54 by thermo compression bonding or ultrasonic welding, regardless of the shape of the resistor element, to complete the resistor in the tenth exemplary embodiment of the present invention.

A detail which differs from the ninth exemplary embodiment of the present invention is a formation area of the protective film 58. The protective film 58 is formed on the resistor element 54 to level with the width m and thickness t of the first and second terminals 55 and 56. This can be achieved by making the thickness of a film of epoxy resin, polyimide resin, or poly-carbodiimide resin thicker than the difference between the top surface level of the resistor element 54 and top surface level of the first and second terminals 55 and 56, and difference between the lower surface level of the resistor element 54 and lower surface level of the first and second terminals 55 and 56; and pressing the film to the same level as the top and bottom faces of the first and second terminals 55 and 56.

Eleventh Exemplary Embodiment

A resistor in an eleventh exemplary embodiment of the present invention is described below with reference to drawings.

FIG. 15(*a*) is a sectional view, and FIG. 15(*b*) is a plan view of the resistor in the eleventh exemplary embodiment of the present invention.

In FIGS. 15(*a*) and 15(*b*), a resistor element 59 is made typically of a sheet or strip of copper-nickel alloy, nickel-chromium alloy, or copper-manganese-nickel alloy. First and second terminals 60 and 61 have an L shape section face, and are provided and electrically connected to both ends of the resistor element 59. The thickness y of these first and second terminals 60 and 61 underneath the resistor element 59 is greater than the thickness x contacting the end face of the resistor element 59. The first and second terminals 60 and 61 are made of metals such as copper, silver, gold, aluminum, copper nickel, or copper zinc with the same or greater electrical conductivity than that of the resistor element 59.

A method for manufacturing the resistor in the eleventh exemplary embodiment of the present invention as configured is basically the same as that described for the resistor in the first exemplary embodiment using FIG. 2. However, in the eleventh exemplary embodiment, the first and second terminals 60 and 61 having the L-shape section face are formed instead of the shape of the first and second terminals illustrated in FIG. 2(*a*). In a process corresponding to FIG. 2(*c*), the resistor element 59 is placed on the first and second terminals 60 and 61. For bonding the resistor element 59 and the first and second terminals 60 and 61, a range of methods may be used: (1) brazing after inserting a third conductive metal such as copper, silver, gold, tin, and solder between the resistor element 59 and the first and second terminals 60 and 61; and (2) applying conductive paste to the resistor element 59 and the first and second terminals 60 and 61, and then thermosetting after fitting the resistor element 59 into the first and second terminals 60 and 61.

Twelfth Exemplary Embodiment

A resistor in a twelfth exemplary embodiment of the present invention is described below with reference to drawings.

FIG. 16 is a sectional view of the resistor in the twelfth exemplary embodiment of the present invention.

In FIG. 16, a resistor element 64 is made typically of copper-nickel alloy, nickel-chromium alloy, or copper-manganese-nickel alloy. An insulating sheet 65, made such as of alumina, glass, glass impregnated epoxy resin, or paper impregnated phenolic resin, is attached to the top face of the resistor element 64. First and second terminals 66 and 67 have an L-shape section face, and are provided and electrically connected to both ends of the resistor element 64. The first and second terminals 66 and 67 are made of metals such as copper, silver, gold, aluminum, copper nickel, or copper zinc with the same or greater electrical conductivity than that of the resistor element 64. The insulating sheet 65 may also be attached to the bottom face of the resistor element 64.

A method for manufacturing the resistor in the twelfth exemplary embodiment as configured above is basically the same as that described for the resistor in the eleventh exemplary embodiment. However, in the twelfth exemplary embodiment, the first and second terminals 66 and 67 having the L-shape section face are formed instead of the shape described in FIG. 2(*a*). In a process corresponding to FIG. 2(*b*), a metal sheet or metal strip such as of copper-nickel alloy, nickel-chromium alloy, or copper-manganese-nickel alloy is formed into the resistor element 64 having a predetermined sheet shape and predetermined resistance, calculated from the volume resistivity, section area, and length, through a range of processes including cutting, punching, and pressing. Then, the insulating sheet 65, made such as of alumina, glass, glass impregnated epoxy resin, or paper impregnated phenolic resin, with the same two-dimensional size as the resistor element 64, is obtained by dividing, cutting, punching, or pressing, and the resistor element 64 and insulating sheet 65 are pasted. In a process corresponding to FIG. 2(*c*), the resistor element 64 is placed on the first and second terminals 60 and 61. For bonding the resistor element 64 and the first and second terminals 66 and 67, a range of methods may be used: (1) brazing after inserting a third conductive metal such as copper, silver, gold, tin, and solder between the resistor element 64 and the first and second terminals 66 and 67; and (2) applying conductive paste to the resistor element 64 and the first and second terminals 66 and 67, and then thermosetting after fitting the resistor element 64 into the first and second terminals 66 and 67.

Thirteenth Exemplary Embodiment

A resistor in a thirteenth exemplary embodiment of the present invention is described below with reference to drawings.

FIG. 17 is a sectional view of the resistor in the thirteenth exemplary embodiment of the present invention.

In FIG. 17, a resistor element 68, made of copper-nickel alloy, nickel-chromium alloy, or copper-manganese-nickel alloy has a shape that both ends are thicker than a central potion, and there is a step between the central portion and ends (its length-wise section face show an H shape). Steps 69 and 70 are provided at both ends 71 and 72 which are thicker than a central portion 73 of the resistor element 68. First and second terminals 74 and 75 are electrically connected to both ends of the resistor element 68, and their section face has a one-side open shape. Inside the first and second terminals 74 and 75 is wider than openings 76 and 77. The first and second terminals 74 and 75 are made of metals such as copper, silver, gold, aluminum, copper nickel or copper zinc which have the same or greater electrical conductivity than that of the resistor element 68.

In FIG. 17, the steps 69 and 70 and the openings 76 and 77 are bent in the thickness direction for preventing detachment, however, the direction is not limited. For example, they may be bent vertical against the thickness direction. The number of steps and bendings are also not limited.

A method for manufacturing the resistor in the thirteenth exemplary embodiment of the present invention as configured above is basically the same as that described for the resistor in the first exemplary embodiment using FIG. 2. A detail which differs is the shape of the material. In a process corresponding to FIG. 2(*a*), inside of the first and second terminals 74 and 75 is broader than their openings 76 and 77. In a process corresponding to FIG. 2(*b*), steps 69 and 70 thicker than the central portion 73 are provided at both ends 71 and 72 of the resistor element 68 in accordance with the shape of the groove of the first and second terminals 74 and 75.

Fourteenth Exemplary Embodiment

A resistor in a fourteenth exemplary embodiment of the present invention is described below with reference to drawings.

FIG. 18 is a sectional view of the resistor in the fourteenth exemplary embodiment of the present invention.

In FIG. 18, an insulating substrate 79 is a sheet of a glass impregnated epoxy resin substrate, paper impregnated phenolic resin substrate, or the like. First and second terminals 80 and 81 are formed on both ends of the insulating substrate 79 for electrically connecting the top and bottom faces of the insulating substrate 79, and are made of metals such as copper, silver, gold, aluminum, copper nickel, or copper zinc with the same or greater electrical conductivity than that of a resistor element 78. A metal layer 82 such as of solder is formed on the top face of the first and second terminals 80 and 81. The resistor element 78 made such as of a sheet of copper-nickel alloy, nickel-chromium alloy, or copper-manganese-nickel alloy is formed on the metal layer 82 in a way to electrically connect the metal layer 82 on the first terminal 80 and the metal layer 82 on the second terminal 81.

In FIG. 18, the top and bottom faces of the insulating substrate 79 are electrically connected by the first and second terminals 80 and 81 on both ends of the insulating substrate 79. This may also be achieved by providing the electrodes which vertically penetrate through the insulating substrate 79.

A method for manufacturing the resistor in the fourteenth exemplary embodiment of the present invention is described next with reference to drawings.

FIGS. 19(*a*) to 19(*c*) are process charts illustrating the manufacturing method of the resistor in the fourteenth exemplary embodiment of the present invention.

In FIG. 19(*a*), a strip of metal foil pattern typically made of copper, silver, or gold having the same or greater electrical conductivity than that of the resistor element 78 is formed on the top, bottom, and side faces of the insulating substrate 79 made typically of a glass impregnated epoxy resin substrate or paper impregnated phenolic resin substrate. Then, the metal foil pattern is exposed to the light and etched to form the first and second terminals 80 and 81 with a predetermined shape.

In FIG. 19(*b*), solder paste 82 is screen printed on the top face of the first and second terminals 80 and 81.

In FIG. 19(*c*), a metal sheet made typically of copper-nickel alloy, nickel-chromium alloy, or copper-manganese-nickel alloy is formed into the resistor element 78 having a predetermined sheet shape and predetermined resistance, calculated from the volume resistivity, section area, and length, through a range of processes including cutting, punching, and pressing. Both ends of the resistor element 78 are placed on the top face of the solder paste 82, and firmly bonded by the reflow process to complete the resistor in the fourteenth exemplary embodiment of the present invention.

In the fourteenth exemplary embodiment of the present invention, the resistor element 78 and the first and second terminals 80 and 81 are bonded by soldering the solder paste 82. This may also be achieved through other methods such as: (1) brazing after inserting a third conductive metal such as copper, silver, gold, tin, and solder between the resistor element 78 and the first and second terminals 80 and 81; and (2) plating and thermal compression bonding the resistor element 78 and first and second terminals 80 and 81.

For adjusting the resistance of the resistor element in the fourteenth exemplary embodiment of the present invention, a through groove may be created on the resistor element 78 or a part of the surface and/or side of the resistor element 78 may be cut by laser, punching, diamond wheel cutting, grinding, etching, and so on while measuring the resistance between predetermined points or calculating required processing after measuring the resistance. The resistance may also be adjusted or corrected at the time of forming the resistor element 78.

Fifteenth Exemplary Embodiment

A resistor in a fifteenth exemplary embodiment of the present invention is described below with reference to drawings.

FIG. 20(*a*) is a sectional view, FIG. 20(*b*) is a plan view of the surface, and FIG. 20(*c*) is a plan view of the rear face of the resistor in the fifteenth exemplary embodiment of the present invention.

In FIGS. 20(*a*) to 20(*c*), a resistor element 83 is made such as of a sheet of copper-nickel alloy, nickel-chromium alloy, or copper-manganese-nickel alloy. An insulating substrate 83 is a sheet of a glass impregnated epoxy resin substrate, paper impregnated phenolic resin substrate, or the like. First, second, third, and fourth terminals 85, 86, 87, and 88 are disposed at four corners of the insulating substrate 84, in a way to electrically connect top and bottom faces of the insulating substrate 84, and are made of metals such as copper, silver, gold, aluminum, copper nickel, or copper zinc with the same or greater electrical conductivity than that of the resistor element 83. The resistor element 83 is electrically connected to the surface of the first, second, third, fourth terminals 85, 86, 87, and 88 through a metal layer 89 on their top faces.

In FIG. 20, the first, second, third, fourth terminals 85, 86, 87, and 88 are formed at four corners of the insulated substrate 84 so as to electrically connect the top and bottom faces of the insulated substrate 84. This may also be achieved by providing the electrodes which vertically penetrate through the insulating substrate 79.

A method for manufacturing the resistor in the fifteenth exemplary embodiment of the present invention is the same as that described using FIG. 19. The difference is that four terminals are formed in the fifteenth exemplary embodiment, while two terminals are formed in the fourteenth exemplary embodiment.

Sixteenth Exemplary Embodiment

A resistor in a sixteenth exemplary embodiment of the present invention is described below with reference to drawings.

FIG. 21(*a*) is a sectional view, and FIG. 21(*b*) is a plan view of the resistor in the sixteenth exemplary embodiment of the present invention.

In FIGS. 21(*a*) and 21(*b*), a resistor element 90 is made such as of a sheet of copper-nickel alloy, nickel-chromium alloy, or copper-manganese-nickel alloy. Rectangular parallelepiped first, second, third, and fourth terminals 91, 92, 93, and 94 are electrically connected respectively at the top and bottom faces of both ends of the resistor element 90.

A method for manufacturing the resistor in the sixteenth exemplary embodiment as configured above is basically the same as that described for the resistor in the first exemplary embodiment using FIG. 2. In a process corresponding to FIG. 2(*a*), four rectangular parallelepiped terminals are formed. In a process corresponding to FIG. 2(*c*), the first and third terminals 91 and 93 are bonded to the top face of both ends of the resistor element 90, using processes such as: (1) inserting a third conductive metals such as copper, silver, gold, tin, or solder between the resistor element and terminals, disposing the first and third terminals 91 and 93 on the top face of both ends of the resistor element 90, and brazing; or (2) applying conductive paste to the resistor element 90 and the first and third terminals 91 and 93, disposing the first and third terminals 91 and 93 on the top face of both ends of the resistor element 90, and thermosetting. Then, the resistor element 90 is turned over to bond the second and fourth terminals 92 and 94 on the bottom face of both ends of the resistor element 90 using the aforementioned processes. The above operation may be implemented at once to bond the first, second, third, and fourth terminals 91, 92, 93, and 94 to the resistor element 90.

FIG. 22 is a sectional view of another example of the resistor in the sixteenth exemplary embodiment of the present invention.

A detail which differs from FIG. 21 in FIG. 22 is that the first and second terminals 91 and 92, and the third and fourth terminals 93 and 94 are electrically connected, and each pair of terminals looks like a single terminal.

Accordingly, the manufacturing method of the example shown in FIG. 22 is that (1) inserting a third conductive metals such as copper, silver, gold, tin, or solder between the resistor element and terminals, disposing the first and third terminals 91 and 93 on the top face of both ends of the resistor element 90, and brazing; or (2) applying conductive paste to the resistor element 90 and the first and third terminals 91 and 93, disposing the first and third terminals 91 and 93 on the top face of both ends of the resistor element 90, and thermosetting. When the resistor element 90 is turned over, after bonding the first and third terminals 91 and 93 on the top face of both ends of the resistor element 90, to bond the second and fourth terminals 92 and 94 on the bottom face of both ends of the resistor element 90, the first and second terminals 91 and 92, and the third and fourth terminals 93 and 94 are simultaneously connected.

Seventeenth Exemplary Embodiment

A resistor in a seventeenth exemplary embodiment of the present invention is described below with reference to drawings.

FIG. 23 is a sectional view of the resistor in the seventeenth exemplary embodiment of the present invention.

In FIG. 23, a resistor element 95, made typically of a sheet of copper-nickel alloy, nickel-chromium alloy, or copper-manganese-nickel alloy has first and second notches 96 and 97 provided near both ends. These first and second notches 96 and 97 in the resistor element 95 are created as a widthwise slit on the resistor element 95. First and second terminals 98 and 99 are made of metals such as copper, silver, gold, aluminum, copper nickel, or copper zinc having the same or greater electrical conductivity than that of the resistor element 95.

First and second protrusions 100 and 101 on the first and second terminals 98 and 99 have the same or smaller size than that of the first and second notches 96 and 97, and they are provided as a widthwise slit on the first and second terminals 98 and 99.

The first and second terminals 98 and 99 are disposed at both ends of the resistor element 95. The first notch 96 on the resistor element 95, and the first protrusion 100 on the first terminal 98, and the second notch 97 on the resistor element 95 and second protrusion 101 on the second terminal 99 are mechanically connected respectively. In addition, the resistor element 95 and the first and second terminals 98 and 99 are electrically connected.

A method for manufacturing the resistor in the seventeenth exemplary embodiment of the present invention is described next with reference to drawing.

The manufacturing method of the resistor in the seventeenth exemplary embodiment of the present invention is basically the same as that described for the resistor in the first exemplary embodiment using FIG. 2. However, the shape of the first and second terminals differ from that described in FIG. 2(*a*). The notches 96 and 97 are also created on the resistor element 95, which is different from the resistor element described in FIG. 2(*b*). The first and second notches 96 and 97 are created such as by cutting and pressing after forming the resistor element 95 with a predetermined sheet shape and predetermined resistance. In a process corresponding to FIG. 2(*c*), as shown in FIG. 23, the resistor element 95 is placed on the first and second terminals 98 and 99 in a way that the first notch 96 on the resistor element 95 fits with the first protrusion 100 on the first terminal 98, and the second notch 97 on the resistor element 95 fits with the second protrusion 101 on the second terminal 99. Then, the resistor element 95 and the first and second terminals 98 and 99 are bonded and connected using the next methods: (1) brazing after inserting a third conductive metal such as copper, silver, gold, tin, and solder between the resistor element 95 and the first and second terminals 98 and 99; and (2) applying conductive paste between the resistor element 95 and the first and second terminals 98 and 99, and thermosetting after fitting the resistor element 95 into the first and second terminals 98 and 99.

Eighteenth Exemplary Embodiment

A resistor in an eighteenth exemplary embodiment of the present invention is described below with reference to drawings.

FIG. 24(*a*) is a sectional view, and FIG. 24(*b*) is a plan view of the resistor in the eighteenth exemplary embodiment of the present invention.

As shown in FIG. 24, a resistor element 102, made such as of copper-nickel alloy, nickel-chromium alloy, or copper-manganese-nickel alloy has first and second through holes 103 and 104. First and second terminals 105 and 106 have first and second protrusions 107 an 108 which can be inserted to the first and second through holes 103 and 104, and are made of metals such as copper, silver, gold, aluminum, copper nickel, or copper zinc having the same or greater electrical conductivity than that of the resistor element 102.

The first and second terminals 105 and 106 are disposed at both ends of the resistor element 102. The first through hole 103 on the resistor element 102, and the first protrusion 107 on the first terminal 105, and the second through hole 104 on the resistor element 102 and second protrusion 108 on the second terminal 106 are mechanically connected respectively. In addition, the resistor element 102 and the first and second terminals 105 and 106 are electrically connected.

A manufacturing method of the resistor in the eighteenth exemplary embodiment of the present invention as configured above is described next with reference to drawings.

FIGS. 25(*a*) to 25(*e*) are process charts illustrating the manufacturing method of the resistor in the eighteenth exemplary embodiment of the present invention.

As shown in FIG. 25(*a*), first and second terminals 105 and 106 have first and second protrusions 107 and 108, and are made of metal sheet or metal strip such as of copper, silver, gold, aluminum, copper nickel, or copper zinc with the same or greater electrical conductivity than that of the resistor element 102 using processes such as cutting, casting, forging, pressing, and drawing.

In FIG. 25(*b*), a metal sheet or metal strip such as of copper-nickel alloy, nickel-chromium alloy, or copper-manganese-nickel alloy is formed into the resistor element 102 having a predetermined sheet shape and predetermined resistance, calculated from the volume resistivity, section area, and length, through a range of processes including cutting, punching, and pressing.

In FIG. 25(*c*), the first and second through holes 103 and 104 are created in both ends of the resistor element 102 using processes such as punching, cutting, and laser.

In FIG. 25(*d*), the first protrusion 107 on the first terminal 105 is inserted into the first through hole 103 on the resistor element 102, and the second protrusion 108 on the second terminal 106 is inserted into the second through hole 104 on the resistor element 102.

In FIG. 25(*e*), the first and second terminals 105 and 106 are bent along the circumference of the resistor element 102 by pressing to sandwich the resistor element 102 in the thickness direction.

The first and second terminals 105 and 106 may not necessary have the shape shown in FIGS. 25(*a*) to 25(*e*). They may just have an opening sufficient for inserting the resistor element 102, and then caulked after inserting the resistor element 102 at both ends.

The resistor element 102 and the first and second terminals 105 and 106 may be bonded and connected using the next methods: (1) brazing after inserting a third conductive metal such as copper, silver, gold, tin, and solder between the resistor element 102 and the first and second terminals 105 and 106; and (2) applying conductive paste between the resistor element 102 and the first and second terminals 105 and 106, and thermosetting.

For adjusting the resistance of the resistor in the eighteenth exemplary embodiment of the present invention, a through groove may be created on the resistor element 102 or a part of the surface and/or side of the resistor element 102 may be cut by laser, punching, diamond wheel cutting, grinding, etching, and so on while measuring the resistance between predetermined points or calculating the required processing after measuring the resistance. The resistance may also be adjusted or corrected at the time of forming the resistor element 102.

In the first exemplary embodiment as described above, the groove 14 of the first and second terminals 12 and 13 is fitted to both ends of the resistor element 11, and then the first and second terminals 2 and 13 are thermally pressed in the vertical direction (to hold the resistor element 11) so that the first and second terminals 12 and 13 are disposed at the top and bottom faces of the resistor element 11. As a result, it has an effect that the resulting resistor may be mounted in either way, regardless of the surface and rear face of the resistor.

In the second exemplary embodiment as described above, a metal sheet is corrugated to the thickness direction to form the resistor element 17. An upper limit of the resistance of the resistor may be increased by bending the resistor element 17 in such a way that the length L of the resistor element 17 becomes longer in the length direction. On the other hand, a lower limit of the resistance of this resistor may be reduced by bending the resistor element 17 in a way that its width W becomes longer.

The second exemplary embodiment of the present invention also has the first and second terminals 18 and 19 which have the groove 20 of the width k equivalent to the thickness T of the resistor element 17. The thickness t of the terminals is thicker than the total thickness V of the resistor element 17, their width m is equivalent to or longer than the width W, and their length w is shorter than the length L of the resistor element 17. This enables to make the resistance of the first and second terminals 18 and 19 smaller than that of the resistor element 17 by the shape, and thus reduces the proportion of the resistance of the first and second terminals 18 and 19 in the entire resistor. This enables to reduce fluctuation in the resistance which is dependant of a resistance measuring terminal on a contact point. Furthermore, since a clearance is provided between the resistor element 17 and a circuit board, thermal damage to a mounting circuit board due to self heat generation of the resistor element 17 is preventable.

The third exemplary embodiment of the present invention comprises the metal sheet resistor element 21, insulating sheet 22 disposed at least on one of the top and bottom faces of the resistor element 21, and the first and second terminals 23 and 24 electrically connected to the resistor element 21. The first and second terminals 23 and 24 have the groove 25 of the width k equivalent to the sum T of the thickness $T_1$ of the resistor element 21 and the thickness $T_2$ of the insulating sheet 22, and are electrically connected to the resistor element 21. The insulating sheet 22 supports or reinforces the resistor element 21, and improves mechanical strength, thus preventing changes in characteristics by deformation.

Also in the third exemplary embodiment, the first and second terminals 23 and 24 have the groove 25 of the width k equivalent to the sum T of the thickness $T_1$ of the resistor element 21 and the thickness $T_2$ of the insulating sheet 22. The thickness t of the first and second terminals 23 and 24 is also thicker than the sum T of the thickness $T_1$ of the resistor element 21 and the thickness $T_2$ of the insulating sheet 22, their width m is equivalent to or wider than the width W of the resistor element 21, and their length w is shorter than the length L of the resistor element 21. This shape enables to make the resistance of the first and second terminals 23 and 24 smaller than that of the resistor element 21, and thus reduces the proportion of the resistance of the first and second terminals 23 and 24 in the entire resistor. Accordingly, fluctuation in the resistance dependent of a resistance measuring terminal on a contact point may be reduced. Furthermore, since a clearance is provided between the resistor element 17 and a substrate, thermal damage to a mounting substrate due to self heat generation of the resistor element 17 is preventable.

The fifth exemplary embodiment of the present invention comprises the metal wire resistor element 29, the concave groove 32 covering both ends of the resistor element 29, and first and second metal terminals 30 and 31 electrically connected to the resistor element 29. The wire resistor element 29 which has the diameter greater than thickness than that of the sheet resistor element enables to obtain the larger resistance than that obtainable with the sheet resistor element. Its mechanical strength can also be reinforced to improve the bending strength of the resistor.

The sixth exemplary embodiment comprises the metal wire resistor element 34 bent into a cylindrical coil shape, concave groove 37 covering both ends of the resistor element 34, and first and second metal terminals 35 and 36 electrically connected to the resistor element 34. The length of the resistor element can be made longer by coiling the resistor element 34, and thus an upper limit of the resistance obtained by the resistor element 34 can be increased.

The seventh exemplary embodiment of the present invention comprises the metal wire resistor element 38 bent symmetrically to the left and right in one plane, concave groove 41 covering both ends of the resistor element 38, and first and second metal terminals 39 and 40 electrically connected to the resistor element 38. Since the metal wire configuring the resistor element 38 is bent symmetrically to the left and right in one plane, the current direction alternates. This enables to cancel the magnetic field generated, and thus reduces magnetic interference of the resistor.

The eighth exemplary embodiment of the present invention comprises a plurality of metal wire resistor elements 42 and 43 which do not directly and electrically contact, concave groove 46 covering both ends of the resistor element 42 and 43, and first and second metal terminals 44 and 45 electrically connected to the resistor element 42 and 43. The resistor elements 42 and 43 are connected in parallel so that the resistance is not adjusted only by the shape of the resistor element. In other words, the resistance is not directly affected by the dimensions of the resistor. This enables to prevent decrease in the strength due to any change in the shape.

The eleventh exemplary embodiment of the present invention comprises the metal sheet resistor element 59, and first and second metal terminals 60 and 61 having an L-shape section face disposed at both ends of the resistor element 59 and electrically connected to the resistor element 59. An inner wall of the L-shape first and second terminals 60 and 61 acts as a reference for positioning the first and second terminals 60 and 61 to both ends of the resistor element 59. This enables to improve the accuracy of connecting position of the first and second terminals 60 and 61 and the resistor element 59, reducing deviation in resistance.

Also in the eleventh exemplary embodiment of the present invention, the thickness y of a portion of the first and second terminals 60 and 61 underneath the resistor element 59 is made thicker than the thickness x of a portion contacting end faces of the resistor element 59, improving heat radiation performance.

The twelfth exemplary embodiment of the present invention comprises the metal sheet resistor element 64, insulating sheet 65 pasted on at least one of the top and bottom faces of the resistor element 64, and the first and second metal terminals 66 and 67 having an L-shape section face disposed at both ends of the resistor element 64 and electrically connected to the resistor element 64. The insulating sheet 65 supports or reinforces the resistor element 64. This enables to improve the mechanical strength and prevent changes in characteristics due to deformation.

The thirteenth exemplary embodiment of the present invention comprises the resistor element 68 provided with the steps 69 and 70 between the central portion 73 and both ends 71 and 72 by making the both ends 71 and 72 thicker than the central portion 73, and the first and second metal terminals 74 and 75 disposed at both ends of the resistor element 68. The first and second metal terminals 74 and 75 have a one-end open section face, and their inside is broader than their opening. The steps 69 and 70 of the resistor element 68 are at least electrically connected to the inside of the opening of the first and second terminals 74 and 75. This mechanical connection of the inside of the opening of the first and second terminals 74 and 75 and the steps 69 and 70 of the resistor element 68 enables to improve the accuracy of bonding position and reliability of bonding between the first and second terminals 74 and 75 and the resistor element 68.

The fourteenth exemplary embodiment of the present invention comprises the metal sheet resistor element 78, insulating substrate 79, and the first and second metal terminals 80 and 81 formed to electrically connect the top and bottom faces of the insulating substrate 79 at both ends. The resistor element 78 and the first and second metal terminals 80 and 81 disposed on the top face of the insulating substrate 79 are also electrically connected. This improves the accuracy of formation position and dimensions of the first and second terminals 80 and 81 to control a connection area of the first and second terminals 80 and 81 and the resistor element 78, reducing dispersion in resistance of the resistor.

The fifteenth exemplary embodiment of the present invention comprises the metal sheet resistor element 83, insulating substrate 84, and four metal terminals 85, 86, 87, and 88 formed to electrically connect the top and bottom faces of the insulating substrate 84. The resistor element 83 and the four metal terminals 85, 86, 87, and 8 disposed on the top face of the insulating substrate 84 are also electrically connected. This achieves a four-terminal resistor, improving the accuracy of current detection.

The sixteenth exemplary embodiment of the present invention comprises the metal resistor element 90 and four metal terminals 91, 92, 93, and 94. Each of the terminals 91, 92, 93, and 94 is disposed on and electrically connected to the top and bottom faces of both ends of the resistor element 90. The four metal terminals 91, 92, 93, and 94 are thus symmetrically disposed, with the resistor element 90 in the center, to the thickness direction of the resistor element 90. This eliminates the directivity of the surface and rear face of the resistor.

The sixteenth exemplary embodiment, as shown in FIG. 22, also has the terminals 91, 92, 93, and 94 disposed on the top and bottom faces of both ends of the resistor element 90, and these terminals are electrically connected to each other. These four terminals 91, 92, 93, and 94 are thus disposed symmetrically, with the resistor element 90 in the center, to the thickness direction of the resistor element 90. This eliminates the directivity of the surface and rear face of the resistor, further increasing the terminal volume for improving radiating performance.

The seventeenth exemplary embodiment of the present invention comprises the metal resistor element 95 having the first and second notches 96 and 97 near its both ends, and the first and second metal terminals 98 and 99 disposed at both ends of the resistor element 95. The first and second terminal 98 and 99 have the first and second protrusions 100 and 101 corresponding to the first and second notches 96 and 97. The resistor element 95 and the first and second terminals 98 and 99 are at least electrically connected through the first and second protrusions 100 and 101, and the first and second notches 96 and 97. The mechanical connection of the protrusions 100 and 101 and the notches 96 and 97 improves the accuracy of position and resistance, and reliability of bonding between the resistor element 95 and the first and second terminals 98 and 99.

The eighteenth exemplary embodiment of the present invention comprises the metal resistor element 102 having two or more first and second through holes 103 and 014, and the first and second metal terminals 105 and 106 disposed at both ends of the resistor element 102. The first and second terminals 105 and 106 have one or more first and second protrusions 107 and 108 with the same shape as the through holes 103 and 104. At least one of the protrusions 107 and 108 of the terminals 105 and 106 is inserted into at least one of the through holes 103 and 104 of the resistor element 102, and at least one face of the terminals 105 and 106 is electrically connected to the resistor element 102. The mechanical connection of the protrusions 107 and 108 and the through holes 103 and 104 improves the accuracy of position and resistance, and reliability of bonding between the resistor element 102 and the first and second terminals 105 and 106.

The manufacturing method of the resistor in the fourteenth exemplary embodiment comprises the steps of forming the first and second terminals 80 and 81 with a metal foil pattern with a predetermined shape whose top and bottom faces are electrically connected to a part of the top, side, and bottom faces of the insulated substrate 79. This enables to use the thin film formation process such as light exposure for the metal foil pattern, and thus the accuracy of shape and formation position can be improved. Accordingly, dispersion in the resistance at terminals and a connected portion between the terminals and resistor element can be reduced.

Nineteenth Exemplary Embodiment

A resistor in a nineteenth exemplary embodiment of the present invention is described below with reference to the drawings.

FIG. 26(*a*) is a sectional view, FIG. 26(*b*) is a plan view, and FIG. 26(*c*) is a sectional view taken along Line A—A in FIG. 26(*a*) of the resistor in the nineteenth exemplary embodiment of the present invention.

In FIGS. 26(*a*) to 26(*c*), a resistor element 111 is typically made of a sheet of copper-nickel alloy, nickel-chromium alloy, copper-manganese-nickel alloy or a combination thereof. First and second concaved terminals 112 and 113 have a concave groove 114 of a width k equivalent to the thickness T of the resistor element 111. The entire surface of the first and second terminals 112 and 113 are coated with a low melting point metal 115 (hereinafter metal 115).

The first and second terminals 112 and 113 are electrically connected to both ends of the resistor element 111 in the groove 114 through the low melting point metal 115. The thickness t of these first and second terminals 112 and 113 is thicker than the thickness T of the resistor element 111; their width m is equivalent to or wider than the width W of the resistor element 111; and their length w is shorter than the length L of the resistor element 111. The first and second terminals 112 and 113 are made of metals such as of copper, silver, gold, or aluminum with the same or greater electrical conductivity than that of the resistor element 111. The metal 115 electrically connects the resistor element 111 and the first and second terminals 112 and 113, and the metal 115 on the circumference of the first and second terminals 112 and 113 also acts as a connecting material when the resistor is mounted on a printed circuit board. Here, the metal 115 refers to metals having a melting point of 500° C. or below, such as tin, tin lead alloy, tin silver alloy, tin antimony alloy, tin zinc alloy, tin bismuth alloy, silver zinc alloy, silver lead alloy, gold tin alloy, or zinc. The use of a metal with a low melting point prevents degradation of resistance characteristics due to oxidization of terminals or resistor element at connecting the terminals and resistor element, which may occur if a metal with a high melting point is used for coating the terminals. An insulating protective film 116, typically made of epoxy resin, polyimide resin, or poly-carbodiimide resin, covers the entire face of the resistor element 111 except the first and second terminals 112 and 113.

A manufacturing method of the resistor in the nineteenth exemplary embodiment of the present invention as configured above is described next with reference to drawings.

FIGS. 27(*a*) to 27(*b*) are process charts illustrating the manufacturing method of the resistor in the nineteenth exemplary embodiment of the present invention.

In FIG. 27(*a*), first and second terminals 112 and 113 are made of metals such as copper, silver, gold, or aluminum with greater electrical conductivity than that of the resistor element 111 using processes such as cutting, casting, forging, pressing, and drawing. The first and second terminals 112 and 113 have a groove 114 of a width k which is equivalent to or greater than the thickness T of the resistor element 111. The thickness t of these first and second terminals 112 and 113 is greater than the thickness T of the resistor element 111; their width m is equivalent to or wider than the width W of the resistor element 111; and their length w is shorter than the length L of the resistor element 111.

In FIG. 27(*b*), the metal 115 is formed on the entire face of the first and second terminals 112 and 113, typically by barrel plating.

In a process shown in FIG. 27(*c*), a metal sheet made of copper-nickel alloy, nickel-chromium alloy, or copper-manganese-nickel alloy is formed into the resistor element 111 by a range of of processes including cutting, punching, and pressing. The resistor element has a predetermined sheet shape and predetermined resistance, calculated from the volume resistivity, section area, and length.

In FIG. 27(*d*), the first and second terminals 112 and 113 are coated with the metal 115 and disposed to both ends of the resistor element 11 through the groove 114, and set on a die for cold forging of the first and second terminals 112 and 113.

Then, a work piece is loaded to and unloaded from an oven held at the temperature above the melting point of the metal 115 (not illustrated) to electrically connect the first and second terminals 112 or 113 and resistor element 111 through the metal 115.

Lastly, in FIG. 27(*e*), the insulated protective film 116, made of a film of epoxy resin, polyimide resin, or poly-carbodiimide resin, is cut into a predetermined shape using processes such as cutting, punching, and pressing, and disposed on the top and bottom faces of the resistor element 111(not illustrated). The insulated protective film 116 is thermal compression bonded on the entire face of the resistor element 111, except on the first and second terminals 112 and 113, thereby completing the resistor in the nineteenth exemplary embodiment of the present invention.

The side face of the first and second terminals 112 and 113, after being connected to the resistor element 111, does not necessarily have a gap or space as shown in FIG. 27. For example, there may be no space, depending on the state of cold forging.

For adjusting the resistance of the resistor in the nineteenth exemplary embodiment of the present invention, a through groove may be created on the resistor element 111. Alternatively, a part of the surface and/or side of the resistor element 111 may be cut by laser, punching, diamond wheel cutting, grinding, etching, and so on while measuring the resistance between predetermined points or calculating the required processing after measuring the resistance. The resistance may also be adjusted or corrected at the time of forming the resistor element 111.

If a material with a lower electrical conductivity than the resistor element 111 is used for the first and second terminals 112 and 113 in the resistor as manufactured above, dispersion in resistance due to variations in the measuring point increases, making it inappropriate for practical use. Accordingly, the first and second terminals 112 and 113 are made of a material having electrical conductivity greater than that of the resistor element 111.

Dispersion in resistance due to the position of the measuring point may also be reduced by making the thickness t of the first and second terminals 112 and 113 thicker than the thickness T of the resistor element 111.

Also, for suppressing temperature rise against heat generated by applying a current, the thickness t of the first and second terminals 112 and 113 is preferably made thicker than the thickness T of the resistor element 111.

The same effects are also achievable when the resistor in the nineteenth exemplary embodiment is manufactured with a process shown in FIG. 27(*c*) implemented before the process shown in FIG. 27(*a*), i.e., in the sequence of manufacture is shown as FIG. 27(*c*), FIG. 27(*a*), FIG. 27(*b*), FIG. 27(*d*), and FIG. 27(*e*).

Twentieth Exemplary Embodiment

A resistor in a twentieth exemplary embodiment of the present invention is described below with reference to drawings.

FIG. 28(*a*) is a sectional view, FIG. 28(*b*) is a plan view, and FIG. 28(*c*) is a sectional view taken along Line B—B in FIG. 28(*b*) of the resistor in the twentieth exemplary embodiment of the present invention.

In FIGS. 28(*a*) to 28(*c*), a resistor element 121 is typically made of a sheet of copper-nickel alloy, nickel-chromium alloy, copper-manganese-nickel alloy or a combination thereof. First and second concaved terminals 122 and 123 have a concave groove 124 of a width k equivalent to the thickness T of the resistor element 111. The entire surface of the first and second terminals 122 and 123 are coated with a low melting point metal 125 such as tin, tin lead alloy, tin silver alloy, tin antimony alloy, tin zinc alloy, tin bismuth alloy, silver zinc, alloy silver lead alloy, gold tin alloy, or zinc typically by plating. The first and second terminals 122 and 123 are electrically connected to both ends of the resistor element 111 in the groove 114 through the metal 125.

The thickness t of these first and second terminals 122 and 123 is thicker than the thickness T of the resistor element 121; their width m is equivalent to or wider than the width W of the resistor element 121; and their length w is shorter than the length L of the resistor element 121. The first and second terminals 122 and 123 are made of metals such as copper, silver, gold, or aluminum with the same or greater electrical conductivity than that of the resistor element 121. The metal 125 electrically connects the resistor element 121 and the first and second terminals 122 and 123. The metal 125 on the circumference of the first and second terminals 122 and 123 also acts as a connecting material when the resistor is mounted on a printed circuit board. Except for the first and second terminals 122 and 123, insulating protective film 126, typically made of epoxy resin, polyimide resin, or poly-carbodiimide resin, covers the entire face of the resistor element 121.

A manufacturing method of the resistor in the twentieth exemplary embodiment of the present invention as configured above, and is described next with reference to drawings.

The manufacturing method of the resistor in the twentieth exemplary embodiment is basically the same as that described for the resistor in the nineteenth exemplary embodiment using FIG. 27. More specifically, in a process shown in FIG. 27(*e*), the insulated protective film 126, is cut into a predetermined shape using processes such as cutting, punching, and pressing, and disposed on the top and bottom faces of the resistor element 121 (not illustrated). The insulated protective film is thermal compression bonded to form the insulated protective film 126 on the entire face of the resistor element 121 except for the first and second terminals 122 and 123. A detail which differs in this process from the nineteenth exemplary embodiment process is the thickness of a film is increased for the purpose of leveling the insulated protective film 126 to the top and bottom face level of the first and second terminals 122 and 123. Thus, pressing is required for adjusting the shape.

In the thermal compression bonding, the resistor element 121 may optionally be pressed for a period to bond the resistor element 121 to the insulated protective film 126, and then the insulated protective film 126 may be heated without applying pressure to accelerate curing.

The manufacturing method of the resistor in the nineteenth exemplary embodiment of the present invention comprises a first process of forming a first and second metal terminals 112 and 113 into a concave shape, and then coating the metal terminals with a low melting point on their entire face of the terminals to obtain the first and second terminals 112 and 113, a second process of creating the metal sheet resistor element 111 whose shape is adjusted to obtain a predetermined resistance, and a third process of covering both ends of the resistor element 111 with the first and second terminals 112 and 113 by cold forging, and electrically connecting the resistor element 111 and the first and second terminals 112 and 113 by heating and cooling. The implementation of the third process enables reduction of contact resistance without deforming the bonded portion which may occur by welding. Thus the process improves electrical connectivity between the resistor element 111 and the first and second terminals 112 and 113, and eliminates the need for forming a bonding material for mounting the resistor onto a printed circuit board after initial coating, thereby improving the productivity.

Industrial Applicability

As described above, the resistor of the present invention comprises a sheet metal resistor element and separate metal terminals electrically connected to both ends of the sheet resistor element. These terminals are made of metal having the same or greater electrical conductivity than that of the resistor element.

With the above configuration, resistance of the terminals can be made smaller than that of the resistor element because the terminals are made of a material having the same or greater electrical conductivity than that of the resistor element. This enables to reduce the proportion of resistance of the terminals in the entire resistor, allowing to ignore its effect on fluctuation of resistance due to deviation in measuring points of a resistance measuring terminal. The present invention can thus assure reproducibility of highly accurate measurement of resistance, providing the resistor which assures highly accurate measurement of resistance even if the measuring point is not precisely placed.

What is claimed is:

1. A low-resistance resistor comprising:

a resistor element made of a metal sheet; and a metal terminal disposed at both ends of said resistor element, an entire surface of said terminal is coated with a metal having a melting point of 500° C. or below, said terminal has an electrical conductivity equal to or greater than that of said resistor element, and said terminal has a groove of a width fittable to said resistor element, and said resistor element and said terminal are electrically connected by inserting said resistor element into said groove with said metal in between.

2. The low-resistance resistor as defined in claim 1, wherein a thickness of said terminal is thicker than a total thickness of said resistor element.

3. The low-resistance resistor as defined in claim 2, wherein a thickness of said terminal is at least three times of a total thickness of said resistor element.

4. The low-resistance resistor as defined in claim 1, wherein at least a part of a surface of said resistor element is covered with an insulating layer.

5. The low-resistance resistor as defined in claim 4, wherein said insulating layer completely covers said resistor element.

6. The low-resistance resistor as defined in claim 4, wherein said insulating layer is made of at least one of epoxy resin, polylmide resin, and poly-carbodiimide resin.

7. A low-resistance resistor comprising:

a resistor element made of metal sheet;

an insulating substrate disposed at least on one of top and bottom faces of said resistor element;

a terminal having a groove of a width equivalent to a sum of a thickness of said resistor element and said insulating substrate, an entire surface of said terminal is coated with a metal having a melting point of 500° C. or below; and said metal formed between said resistor element and said groove;

wherein said resistor element and said terminal are electrically connected through said metal.

8. The low-resistance resistor as defined in claim 7, wherein said insulating substrate is made of one of alumina, glass, glass impregnated epoxy resin substrates, and paper impregnated phenolic resin substrates.

9. The low-resistance resistor as defined in claim 7, wherein an insulating layer covers a part of a surface of said resistor element.

10. The low-resistance resistor as defined in claim 7, wherein a thickness of said terminal is at least three times of a sum of a thickness of said resistor element and a thickness of said insulating substrate.

11. A method for manufacturing a low-resistance resistor comprising:

forming a resistor element made of a metal sheet, said resistor element having a shape adjusted to obtain a predetermined resistance;

forming a metal terminal having a groove;

coating an entire surface of said metal terminal with a metal having a melting point of 500° C. or below;

fitting said terminal to both ends of said resistor element; and electrically connecting said resistor element and said terminal;

wherein a third metal layer is formed on at least one of a) a connecting portion of said resistor element, and b) connecting portion of said terminal before fitting said terminal to said resistor element.

12. The method for manufacturing a low-resistance resistor as defined in claim 11, further comprising the step of forming an insulating layer except on said terminal after said step of electrical connection.

13. The method for manufacturing a low-resistance resistor as defined in claim 12, wherein a step of trimming resistance is added before said step of forming said insulating layer.

14. The method for manufacturing a low-resistance resistor as defined in claim 12, wherein said terminal is electrically connected to both ends of said resistor element by one of pressing, caulking, and cold forging, and then one of heating, thermal compression bonding, brazing, and ultrasonic welding.

15. The method for manufacturing a resistor as defined in claim 12, wherein said step of electrically connecting said resistor element and terminal comprises:

coating said at least one of said resistor element and terminal with metal different from that used for forming said resistor element and said terminal;

connecting said resistor element and said terminal, after assembling coated resistor element and terminal, by one of brazing, pressing, and ultrasonic welding.

16. The method for manufacturing a low-resistance resistor as defined in claim 11, wherein said terminal is electrically connected to both ends of said resistor element by one of pressing, caulking, and cold forging, and then one of heating, thermal compression bonding, brazing, and ultrasonic welding.

17. The method for manufacturing a low-resistance resistor as defined in claim 11, wherein said step of forming said third metal layer is implemented by one of plating and paste printing.

18. The method foe manufacturing a resistor as defined claim 11, wherein said step of electrically connecting said resistor element and terminal comprises:

coating said at least one of said resistor element and terminal with metal different from that used for forming said resistor element and said terminal;

connecting said resistor element and said terminal, after assembling coated resistor element and terminal, by one of brazing, pressing, and ultrasonic welding.

19. The method of manufacturing a low resistance resistor as defined in claim 11, wherein said coating is performed by plating.

20. A method for manufacturing a resistor comprising:

forming a terminal made of a metal foil pattern with a predetermined shape on a part of top and bottom faces of an insulating substrate, said terminal being electrically connected to top, side, and bottom faces of said insulating substrate;

coating an entire surface of said terminal with a metal having a melting point of 500° C. or below;

dividing said insulating substrate into a predetermined shape;

forming a metal resistor element, said resistor element having a shape adjusted to obtain a predetermined resistance;

electrically connecting said resistor element to the metal foil pattern on the top face of said insulating substrate.

21. The method for manufacturing a low-resistance resistor as defined in claim 20, wherein said terminal is electrically connected to both ends of said resistor element by one of pressing, caulking, and cold forging, and then one of heating, thermal compression bonding, brazing, and ultrasonic welding.

22. The method for manufacturing a resistor as defined in claim 20, wherein said step of electrically connecting said resistor element and terminal comprises:

coating said at least one of said resistor element and terminal with metal different from that used for forming said resistor element and said terminal;

connecting said resistor element and said terminal, after assembling coated resistor element and terminal, by one of brazing, pressing, and ultrasonic welding.

23. The method of manufacturing a low resistance resistor as defined in claim 20, wherein said coating is performed by plating.

* * * * *

UNITED STATES PATENT AND TRADEMARK OFFICE

CERTIFICATE OF CORRECTION

PATENT NO. : 6,801,118 B1
DATED : October 5, 2004
INVENTOR(S) : Ikemoto et al.

It is certified that error appears in the above-identified patent and that said Letters Patent is hereby corrected as shown below:

Column 27,
Line 61, “polylmide” should read -- polyimide --

Column 29,
Line 5, “foe” should read -- for --

Signed and Sealed this

Twenty-sixth Day of April, 2005

JON W. DUDAS
*Director of the United States Patent and Trademark Office*